US005665262A

United States Patent [19]

Hajaligol et al.

[11] Patent Number: 5,665,262

[45] Date of Patent: Sep. 9, 1997

[54] TUBULAR HEATER FOR USE IN AN ELECTRICAL SMOKING ARTICLE

[75] Inventors: Mohammad R. Hajaligol, Richmond; Grier S. Fleischhauer, Midlothian, both of Va.; Seetharama C. Deevi, Oak Ridge, Tenn.; Charles T. Higgins, Richmond; Patrick H. Hayes, Chester, both of Va.; Herbert Herman, Port Jefferson; Robert V. Gansert, Lake Grove, both of N.Y.; Alfred L. Collins, Powhatan, Va.; Billy J. Keen, Jr., Chesterfield, Va.; Bernard C. Laroy, Richmond, Va.; A. Clifton Lilly, Jr., Chesterfield, Va.

[73] Assignee: Philip Morris Incorporated, New York, N.Y.

[21] Appl. No.: 370,125

[22] Filed: Jan. 9, 1995

Related U.S. Application Data

[63] Continuation of Ser. No. 224,848, Apr. 8, 1994, abandoned, which is a continuation-in-part of Ser. No. 118,665, Sep. 10, 1993, Pat. No. 5,388,594, which is a continuation-in-part of Ser. No. 943,504, Sep. 11, 1992, Pat. No. 5,502,214, which is a continuation-in-part of Ser. No. 666,926, Mar. 11, 1991, abandoned.

[51] Int. Cl.[6] ..... H05B 3/10; A24F 1/22

[52] U.S. Cl. ..... 219/553; 219/543; 131/194

[58] Field of Search ..... 219/538, 539, 219/542, 543, 553; 338/283; 392/386; 501/102–105; 131/194, 195

[56] References Cited

U.S. PATENT DOCUMENTS

| | | |
|---|---|---|
| 1,771,366 | 7/1930 | Wyss et al. . |
| 1,968,509 | 7/1934 | Tiffany . |
| 2,057,353 | 10/1936 | Whittemore . |
| 2,104,266 | 1/1938 | McCormick . |
| 2,442,004 | 5/1948 | Hayward-Butt . |

(List continued on next page.)

FOREIGN PATENT DOCUMENTS

| | | |
|---|---|---|
| 1202378 | 3/1986 | Canada . |
| 87/104459 | 2/1988 | China . |
| 0 438 862 | 7/1982 | European Pat. Off. . |
| 0 295 122 | 12/1988 | European Pat. Off. . |
| 0 358 002 | 3/1990 | European Pat. Off. . |
| 0 358 114 | 3/1990 | European Pat. Off. . |
| 0 430 566 | 6/1991 | European Pat. Off. . |

(List continued on next page.)

OTHER PUBLICATIONS

Amin, "Arc Spray Coatings Using Inert Gases," TWI Bulletin 6, pp. 129–132, Nov./Dec. 1992.

(List continued on next page.)

*Primary Examiner*—Teresa J. Walberg
*Assistant Examiner*—Sam Paik
*Attorney, Agent, or Firm*—James T. Moore; James E. Schardt; Charles E. B. Glenn

[57] ABSTRACT

A cylindrical tube is provided of a mechanically strong and flexible electrical conductor such as a metal and has a plurality of separated regions. An electrically insulating layer such as a ceramic is applied on the outer surface except for one exposed portion. Electrically resistive heaters are then applied to the insulated regions and are electrically connected at one end to the underlying electrical conducting region. The electrical conductor is connected to the negative terminal of a power source. The other end of all the heaters are adapted to be connected to the positive terminal of the source. Accordingly, an electrically resistive heating circuit is formed wherein the tube serves as a common for all of the heating elements. The tubular heater can comprise an exposed end hub with a plurality of blades extending therefrom. Each blade can have an individual heater deposited thereon. Alternatively, every other blade can have a heater deposited thereon. The blades having no heater function as barriers to minimize outward escape of generated vapors. These barrier blades also function as heat sinks for the heaters on adjacent blades.

79 Claims, 15 Drawing Sheets

U.S. PATENT DOCUMENTS

| | | | |
|---|---|---|---|
| 2,971,039 | 2/1961 | Westeren . | |
| 2,974,669 | 3/1961 | Ellis . | |
| 3,200,819 | 8/1965 | Gilbert . | |
| 3,255,760 | 6/1966 | Selke . | |
| 3,363,633 | 1/1968 | Weber . | |
| 3,402,723 | 9/1968 | Hu . | |
| 3,482,580 | 12/1969 | Hollabaugh . | |
| 3,608,560 | 9/1971 | Briskin et al. . | |
| 3,738,374 | 6/1973 | Bennett . | |
| 3,744,496 | 7/1973 | McCarty et al. . | |
| 3,804,100 | 4/1974 | Fariello . | |
| 3,889,690 | 6/1975 | Guarnieri . | |
| 4,016,061 | 4/1977 | Wasa et al. . | |
| 4,068,672 | 1/1978 | Guerra . | |
| 4,077,784 | 3/1978 | Vayrynen . | |
| 4,131,119 | 12/1978 | Blasutti . | |
| 4,141,369 | 12/1979 | Burruss . | |
| 4,164,230 | 8/1979 | Pearlman . | |
| 4,193,411 | 3/1980 | Faris et al. . | |
| 4,215,708 | 8/1980 | Bron . | |
| 4,219,032 | 8/1980 | Tabatnik et al. . | |
| 4,246,913 | 1/1981 | Ogden et al. . | |
| 4,256,945 | 3/1981 | Carter et al. . | |
| 4,259,970 | 4/1981 | Green, Jr. . | |
| 4,303,083 | 12/1981 | Burruss, Jr. . | |
| 4,319,591 | 3/1982 | Keith et al. . | |
| 4,393,884 | 7/1983 | Jacobs . | |
| 4,431,903 | 2/1984 | Riccio . | |
| 4,436,100 | 3/1984 | Green, Jr. . | |
| 4,463,247 | 7/1984 | Lawrence et al. . | |
| 4,503,319 | 3/1985 | Moritoki et al. . | |
| 4,505,282 | 3/1985 | Cogbill et al. . | |
| 4,507,394 | 3/1985 | Mase et al. | 501/103 |
| 4,562,337 | 12/1985 | Lawrence . | |
| 4,570,646 | 2/1986 | Herron . | |
| 4,580,583 | 4/1986 | Green, Jr. . | |
| 4,621,649 | 11/1986 | Osterrath . | |
| 4,623,401 | 11/1986 | Derbyshire et al. . | |
| 4,637,407 | 1/1987 | Bonanno et al. . | |
| 4,659,680 | 4/1987 | Guile | 501/103 |
| 4,659,912 | 4/1987 | Derbyshire . | |
| 4,732,168 | 3/1988 | Resee et al. . | |
| 4,735,217 | 4/1988 | Gerth et al. . | |
| 4,771,796 | 9/1988 | Myer . | |
| 4,776,353 | 10/1988 | Lilja et al. . | |
| 4,788,077 | 11/1988 | Kang . | |
| 4,837,421 | 6/1989 | Luthy . | |
| 4,846,199 | 7/1989 | Rose . | |
| 4,848,376 | 7/1989 | Lilja et al. . | |
| 4,874,924 | 10/1989 | Yamamoto et al. . | |
| 4,877,989 | 10/1989 | Drews . | |
| 4,891,343 | 1/1990 | Quadair | 501/103 |
| 4,922,901 | 5/1990 | Brooks et al. . | |
| 4,945,931 | 8/1990 | Gori . | |
| 4,947,874 | 8/1990 | Brooks et al. . | |
| 4,947,875 | 8/1990 | Brooks et al. . | |
| 4,966,171 | 10/1990 | Serrano et al. . | |
| 4,981,522 | 1/1991 | Nichols et al. . | |
| 4,991,606 | 2/1991 | Serrano et al. . | |
| 5,040,552 | 8/1991 | Nystrom et al. . | |
| 5,060,671 | 10/1991 | Counts et al. | 131/329 |
| 5,076,296 | 12/1991 | Schleich et al. . | |
| 5,093,894 | 3/1992 | Deevi et al. . | |
| 5,095,921 | 3/1992 | Losee et al. | 131/194 |
| 5,144,962 | 9/1992 | Counts et al. . | |
| 5,157,242 | 10/1992 | Hetherington et al. . | |
| 5,159,940 | 11/1992 | Hayward et al. . | |
| 5,224,498 | 7/1993 | Deevi et al. | 131/194 |
| 5,235,157 | 8/1993 | Blackburn | 219/268 |
| 5,249,586 | 10/1993 | Morgan et al. . | |
| 5,274,214 | 12/1993 | Blackburn | 219/268 |
| 5,285,050 | 2/1994 | Blackburn | 219/268 |
| 5,322,075 | 6/1994 | Deevi et al. . | |
| 5,353,813 | 10/1994 | Deevi et al. . | |
| 5,369,723 | 11/1994 | Counts et al. . | |
| 5,388,594 | 2/1995 | Counts et al. . | |

FOREIGN PATENT DOCUMENTS

| | | |
|---|---|---|
| 0 503 767 A1 | 9/1992 | European Pat. Off. . |
| 36 40 917 | 8/1988 | Germany . |
| 37 35 704 | 5/1989 | Germany . |
| 61-68061 | 4/1986 | Japan . |
| 64-17386 | 1/1989 | Japan . |
| 2 132 539 | 7/1984 | United Kingdom . |
| 2 148 079 | 5/1985 | United Kingdom . |
| 2 148 676 | 5/1985 | United Kingdom . |
| 86/02528 | 5/1986 | WIPO . |
| WO 94/06314 | 3/1994 | WIPO . |

OTHER PUBLICATIONS

Blunt et al, "High Velocity Spraying for Electronic Substrates," TWI Connect—World Centre for Materials Joining Technology, No. 40, Dec. 1992.

Filmer et al, "Plasma Spray Deposition of Alumina–Based Ceramic," Ceramic Bulletin, vol. 69, No. 12, pp. 1955–1958, 1990.

Herman, "Coatings and Coating Practices," Advanced Materials & Processes, pp. 59–60, 84–85, Jan. 1990.

Herman, "Plasma–Sprayed Coatings," Scientific American, pp. 112–116, 1988.

Herman, "Plasma Spray Deposition Processes," MRS Bulletin, pp. 60–67, 1988.

Sampath et al, "Microstructure and Properties of Plasma–Spray Consolidated/Two–Phase Nickel Aluminides," vol. 25, pp. 1425–1430, 1991.

Sampath et al, "Structure and Properties of Vacuum Plasma Sprayed Hard Coatings," Memories et Etudes Scientifiques Revue de Metallurgie, pp. 289–294, Mai 1991.

Srivatsan et al, "Review Use of Spray Techniques to Synthesize Particulate–Reinforced Metal–Matrix Composites," Journal of Materials Science 27, pp. 5965–5981, 1992.

Street et al, "Trends In Laser Cutting of Advanced Materials," TWI Bulletin 5, pp. 108–111, Sep./Oct. 1992.

Tiwari et al, Spray Forming of $MoSi_2$ and $MoSi_2$–Based Composites, Mat. Res. Soc. Symp. Proc., vol. 213, Materials Research Society, pp. 807–813, 1991.

Tiwari et al, "Thermal Spray Forming of Particulate Composites," Dept. of Mat. Sci. & Engineering, State University of New York, Stony Brook, NY 11794–2275 and Flame Spray Industries, Inc., 152 Haven Avenue, Port Washington, NY 11050.

Tiwari et al, "Incorporating of Reinforcements in Spray Formed MMCs", Department of Materials Science and Engineering, State University of New York, Stony Brook, NY 11794–2275.

Travis, "Making Materials That Are Good to the Last Drop," Research News, vol. 258, p. 1307, Nov. 1992.

Wang et al, "Activation Energy for Crystal Growth Using Isothermal and Continuous Heating Processes", Journal of Materials Science, Chapman and Hall, vol. 25, pp. 2339–2343, 1990.

Wang et al, "Thermomechanical Properties of Plasma–Sprayed Oxides in the $MgO–Al_2O_3–SiO_2$ system," Surface and Coatings Technology, vol. 42, pp. 203–216, 1990.

Wu et al, "Heat Transfer to a Particle in a Thermal Plasma," Trans IChemE, vol. 69, Part A, pp. 21–24, Jan. 1991.

Zaat, "A Quarter of a Century of Plasma Spraying," Ann. Rev. Mater. Sci.by Annual Reviews, Inc., pp. 13:9–42, 1983.
Zatorski et al, "Wear of Plasma–Sprayed Alumina–Titania Coatings," High Performance Ceramic Films and Coatings by Elsevier Science Publishers B.V., pp., 591–601, 1991.
Fen et al., "Cyclic oxidation of Haynes 230 alloy," Chapman & Hall, pp. 1514–1520 (1992).
Reinshagen and Sikka, "Thermal Spraying of Selected Aluminides," Proceedings of the Fourth National Thermal Spray Conference, Pittsburgh, PA USA, pp. 307–313 (4–10 May 1991).
Kutner, "Thermal spray by design," Reprint from Advanced Materials & Processes Incorporating Metal Progress, Oct. (1988).
"Characterizing Thermal Spray Coatings," Article based on presentations made at the Fourth National Thermal Spray Conference, 4–10 May (1991) and appearing in Advanced Materials and Processes, May 1992, pp. 23–27.
Howes, Jr., "Computerized Plasma Control for Applying Medical–Quality Coatings," Industrial Heating, pp. 22–25, Aug., 1993.
V. Sikka, "Processing of Intermetallic Aluminides", Intermetallic Metallurgy and Processing Intermetallic Compounds, ed. Stoloff et al., Van Mestrand Reinhold, N.Y., 1994.
Excerpt from "NASA Tech Briefs," Jul./Aug. 1988, p. 31.
"PCT Thermistors," Keystone Carbon Company product literature.

TUBULAR HEATER FOR USE IN AN ELECTRICAL SMOKING ARTICLE

CROSS REFERENCE TO RELATED APPLICATIONS

The present application is commonly assigned patent application Ser. No. 08/224,848, filed Apr. 8, 1994, abandoned which is a continuation-in-part of patent application Ser. No. 08/118,665, filed Sep. 10, 1993, U.S. Pat. No. 5,388,594, which in turn is a continuation-in-part of commonly assigned patent application Ser. No. 07/943,504, filed Sep. 11, 1992, U.S. Pat. No. 5,502,214, which in turn is a continuation-in-part of patent application Ser. No. 07/666,926 filed Mar. 11, 1991, now abandoned in favor of file-wrapper continuation application Ser. No. 08/012,799, filed Feb. 2, 1993, which is now U.S. Pat. No. 5,249,586, issued Oct. 5, 1993. The present application relates to commonly assigned copending U.S. patent applications Ser. No. 08/365,952 filed Dec. 29, 1994 (Attorney Docket No. PM 1767), Ser. No. 07/943,747, filed Sep. 11, 1992 and to commonly assigned U.S. Pat. No. 5,060,671, issued Oct. 29, 1991; U.S. Pat. No. 5,095,921, issued Mar. 17, 1992; and U.S. Pat. No. 5,224,498, issued Jul. 6, 1992. All of these referenced and related patents and applications, are hereby incorporated by reference.

BACKGROUND OF THE INVENTION

1. Technical Field of the Invention

The present invention relates generally to heaters for use in an electrical smoking article and more particularly to a tubular heater for use in an electrical smoking article.

2. Discussion of the Related Art

Previously known conventional smoking devices deliver flavor and aroma to the user as a result of combustion of tobacco. A mass of combustible material, primarily tobacco, is oxidized as the result of applied, heat with typical combustion temperatures in a conventional cigarette being in excess of 800° C. during puffing. Heat is drawn through an adjacent mass of tobacco by drawing on the mouth end. During this heating, inefficient oxidation of the combustible material takes place and yields various distillation and pyrolysis products. As these products are drawn through the body of the smoking device toward the mouth of the user, they cool and condense to form an aerosol or vapor which gives the consumer the flavor and aroma associated with smoking.

Conventional cigarettes have various perceived drawbacks associated with them. Among them is the production of sidestream smoke during smoldering between puffs, which may be objectionable to some non-smokers. Also, once lit, they must be fully consumed or be discarded. Relighting a conventional cigarette is possible but is usually an unattractive prospect for subjective reasons (flavor, taste, odor) to a discerning smoker.

A prior alternative to the more conventional cigarettes include those in which the combustible material itself does not directly provide the flavorants to the aerosol inhaled by the smoker. In these smoking articles, a combustible heating element, typically carbonaceous in nature, is combusted to heat air as it is drawn over the heating-element and through a zone which contains heat-activated elements that release a flavored aerosol. While this type of smoking device produces little or no sidestream smoke, it still generates products, of combustion, and once lit it is not adapted to be snuffed for future use in the conventional sense.

In both the more conventional and carbon element heated smoking devices described above combustion takes place during their use. This process naturally gives rise to many by-products as the combusted material breaks down and interacts with the surrounding atmosphere.

Commonly assigned U.S. Pat. Nos. 5,093,894; 5,225,498; 5,060,671 and 5,095,921 disclose various electrical resistive heating elements and flavor generating articles which significantly reduce sidestream smoke while permitting the smoker to selectively suspend and reinitiate smoking. However, the cigarette articles disclosed in these patents are not very durable and may collapse, tear or break from extended or heavy handling. In certain circumstances, these prior cigarette articles, may crush as they are inserted into the electric lighters. Once they are smoked, they are even weaker and :may tear or break as they are removed from the lighter.

U.S. patent application Ser. No. 08/118,665, filed Sep. 10, 1993, describes an electrical smoking system including a novel electrically powered lighter and novel cigarette that is adapted to cooperate-with the lighter. The preferred embodiment of the lighter includes a plurality of metallic sinusoidal heaters disposed in a configuration that slidingly receives a tobacco rod portion of the cigarette.

The preferred embodiment of the cigarette of Ser. No. 08/118,665 preferably comprises a tobacco-laden tubular carrier, cigarette paper overwrapped about the tubular carrier, an arrangement of flow-through filter plugs at a mouthpiece end of the carrier and a filter plug at the opposite (distal) end of the carrier, which preferably limits air flow axially through the cigarette. The cigarette and the lighter are configured such that when the cigarette is inserted into the lighter and as individual heaters are activated for each puff, localized charring occurs at spots about the cigarette in the locality where each heater was bearing against the cigarette. Once all the heaters have been activated, these charred spots are closely spaced from one another and encircle a central portion of the carrier portion of the cigarette. Depending on the maximum temperatures and total energies delivered at the heaters, the charred spots manifest more than mere discolorations of the cigarette paper. In most applications, the charring will create at least minute breaks in the cigarette paper and the underlying carrier material, which breaks tends to mechanically weaken the cigarette. For the cigarette to be withdrawn from the lighter, the charred spots must be at least partially slid past the heaters. In aggravated circumstances, such as when the cigarette is wet or toyed with or twisted, the cigarette may be prone to break or leave pieces upon its, withdrawal from the lighter. Pieces left in the lighter fixture can interfere with the proper operation of the lighter and/or deliver an off-taste to the smoke of the next cigarette. If the cigarette breaks in two while being withdrawn, the smoker may be faced not only with the frustration of failed cigarette product, but also with the prospect of clearing debris from a clogged lighter before he or she can enjoy another cigarette.

The preferred embodiment of the cigarette of Ser. No. 08/118,665 is essentially a hollow tube between the filter plugs at the mouthpiece end of the cigarette and the plug at the distal end. This construction is believed to elevate delivery to the smoker by providing sufficient space into which aerosol can evolve off the carrier with minimal impingement and condensation of the aerosol on any nearby surfaces.

Several proposals have been advanced which significantly reduce undesired sidestream smoke while permitting the smoker to suspend smoking of the article for a desired period and then to resume smoking. For example, commonly assigned U.S. Pat. Nos. 5,093,894; 5,225,498; 5,060,671 and 5,095,921 disclose various heating elements and flavor generating articles Parent application Ser. No. 08,118,665 discloses an electrical smoking article having heaters which are-actuated upon sensing of a draw by control and logic circuitry. The heaters are preferably a relatively thin serpentine structure to transfer adequate amounts of heat to the cigarette and is lightweight.

Although these devices and heaters overcome the observed problems and achieve the stated objectives, many embodiments are plagued by the formation of a significant amount of condensation formed as the tobacco flavor medium is heated to form vapors. These vapors can cause problems as they condense on relatively cooler various electrical contacts and the associated control and logic circuitry. In addition, condensation can influence the subjective flavor of the tobacco medium of the cigarette. Though not desiring to be bound by theory, it is believed that the condensation is the result of the flow pattern and pressure gradient of ambient air drawn through the article and the current designs of the heater assemblies. The heating of the tobacco flavor medium releases vapors which are then cooled to result in condensation on the surfaces of relatively cooler components. The condensation can cause shorting and other undesired malfunctions.

In addition, the proposed heaters are subject to mechanical weakening and possible failure due to stresses induced by inserting and removing the cylindrical tobacco medium and also by adjusting or toying with the inserted cigarette.

Also, the electrical smoking articles employ electrically resistive heaters which have necessitated relatively complex electrical connections which can be disturbed by insertion and removal of the cigarette.

OBJECTS OF THE INVENTION

It is accordingly an object of the present invention to provide a heater which generates smoke from a tobacco medium without sustained combustion.

It is another object of the present invention to provide a heater for a smoking article which reduces the creation of undesired sidestream smoke.

It is yet another object of the present invention to provide a heater for a smoking article which permits the smoker to suspend and resume use.

It is a further object of the present invention to accomplish the foregoing objects while reducing aerosol or smoke condensation within the smoking article.

It is yet another object of the present invention to provide a heater structure which provides a desired number of puffs and which is straightforwardly modified to change the number and or duration of puffs provided without sacrificing subjective qualities of the tobacco.

It is another object of the present invention to provide a method of making such a heater to accomplish the foregoing objects.

It is a further object of the present invention to provide a heating element for a smoking article which is mechanically suitable for insertion and removal of a cigarette.

It is another object of the present invention to simplify connections of an electrically resistive heater to an associated power source.

It is a further object of the present invention to provide such a heater which is more economical to manufacture.

It is another object of the present invention to accomplish the foregoing objects simply and in a straightforward manner.

Additional objects and advantages of the present invention are apparent from the drawings and specification which follow.

SUMMARY OF THE INVENTION

The foregoing and additional objects are obtained by a heater according to the present invention. A cylindrical tube is provided of a mechanically strong and flexible electrical conductor such as a metal and has a plurality of separated regions. An electrically insulating layer such as a ceramic is applied on the outer surface except for one exposed portion. Electrically resistive materials are then applied to the insulated regions and are electrically connected at one end to the underlying electrical conducting region to form heater elements. This electrical conducting region is connected to the negative terminal of a power source. The other end of all the heaters are adapted to be connected to the positive terminal of the source. Accordingly, an electrically resistive heating circuit is formed wherein the tube serves as a common for all of the heating elements.

The tubular heater can comprise an exposed end hub with a plurality of blades extending therefrom. Each blade can have an individual heater deposited thereon. Alternatively, every other blade can have a heater deposited thereon. The blades having no heater function as barriers to minimize outward escape of generated vapors. These barrier blades also function as heat sinks for the heaters on adjacent blades.

DETAILED DESCRIPTION OF THE PREFERRED EMBODIMENTS

Figure 1:
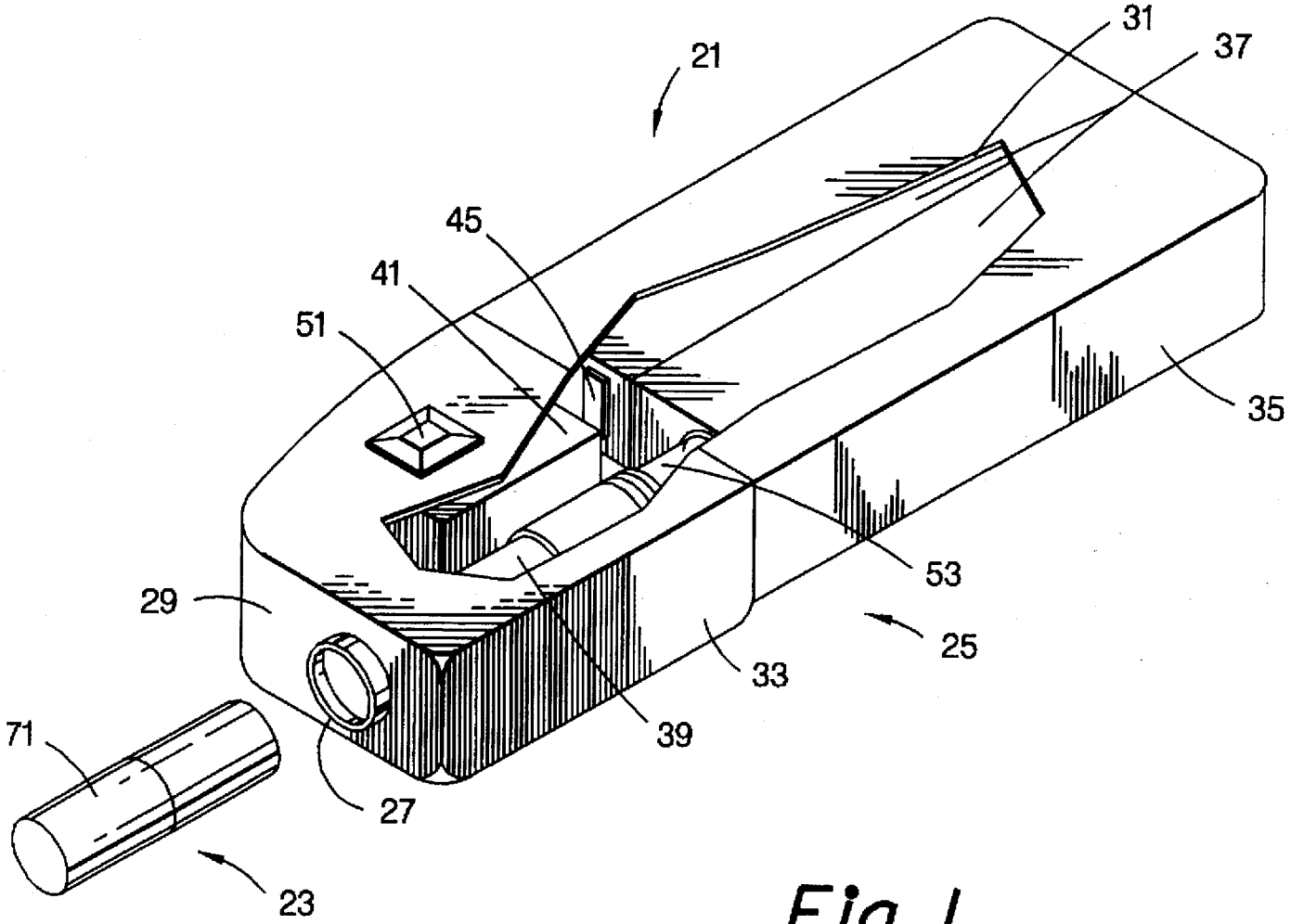
FIG. 1 is a partially exposed perspective view of a smoking article employing a heater according to the present invention.
Figure 2:
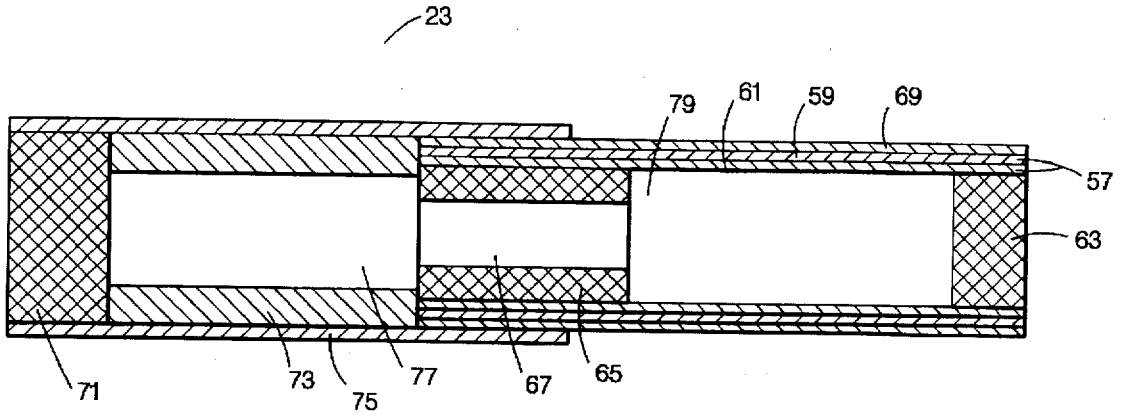
FIG. 2 is a side, cross-sectional view of a cigarette used in conjunction with the present invention.

A smoking system 21 according to the present invention is generally seen with reference to FIGS. 1 and 2. The smoking system 21 includes a cylindrical aerosol generating tube or cigarette 23 and a reusable lighter 25. The cigarette 23 is adapted to be inserted in and removed from an orifice 27 at a front end 29 of the lighter 25. The smoking system 21 is used in much the same fashion as a conventional cigarette. The cigarette 23 is disposed of after one or more puff cycles. The lighter 25 is preferably disposed of after a greater number of puff cycles than the cigarette 23.

The lighter 25 includes a housing 31 and has front and rear portions 33 and 35. A power source 37 for supplying energy to heating elements for heating the cigarette 23 is preferably disposed in the rear portion 35 of the lighter 25. The rear portion 35 is preferably adapted to be easily opened and closed, such as with screws or with snap-fit components, to facilitate replacement of the power source 37. The front portion 33 preferably houses heating elements and circuitry in electrical communication with the power source 37 in the rear portion 35. The front portion 33 is preferably easily joined to the rear portion 35, such as with a dovetail joint or by a socket fit. The housing 31 is preferably made from a hard, heat-resistant material. Preferred materials include metal-based or, more preferably, polymer-based materials. The housing 31 is preferably adapted to fit comfortably in the hand of a smoker and, in a presently preferred embodiment, has overall dimensions of 10.7 cm by 3.8 cm by 1.5 cm.

The power source 37 is sized to provide sufficient power for heating elements that heat the cigarette 23. The power source 37 is preferably replaceable and rechargeable and may include devices such as a capacitor, or more preferably, a battery. In a presently preferred embodiment, the power source is a replaceable, rechargeable battery such as four nickel cadmium battery cells connected in series with a total, non-loaded voltage of approximately 4.8 to 5.6 volts. The characteristics required of the power source 37 are, however, selected in view of the characteristics of other components in the smoking system 21, particularly the characteristics of the heating elements. U.S. Pat. No. 5,144,962 describes several forms of power sources useful in connection with the smoking system of the present invention, such as rechargeable battery sources and quick-discharging capacitor power sources that-are charged by batteries, and is hereby incorporated by reference.

Figure 3:
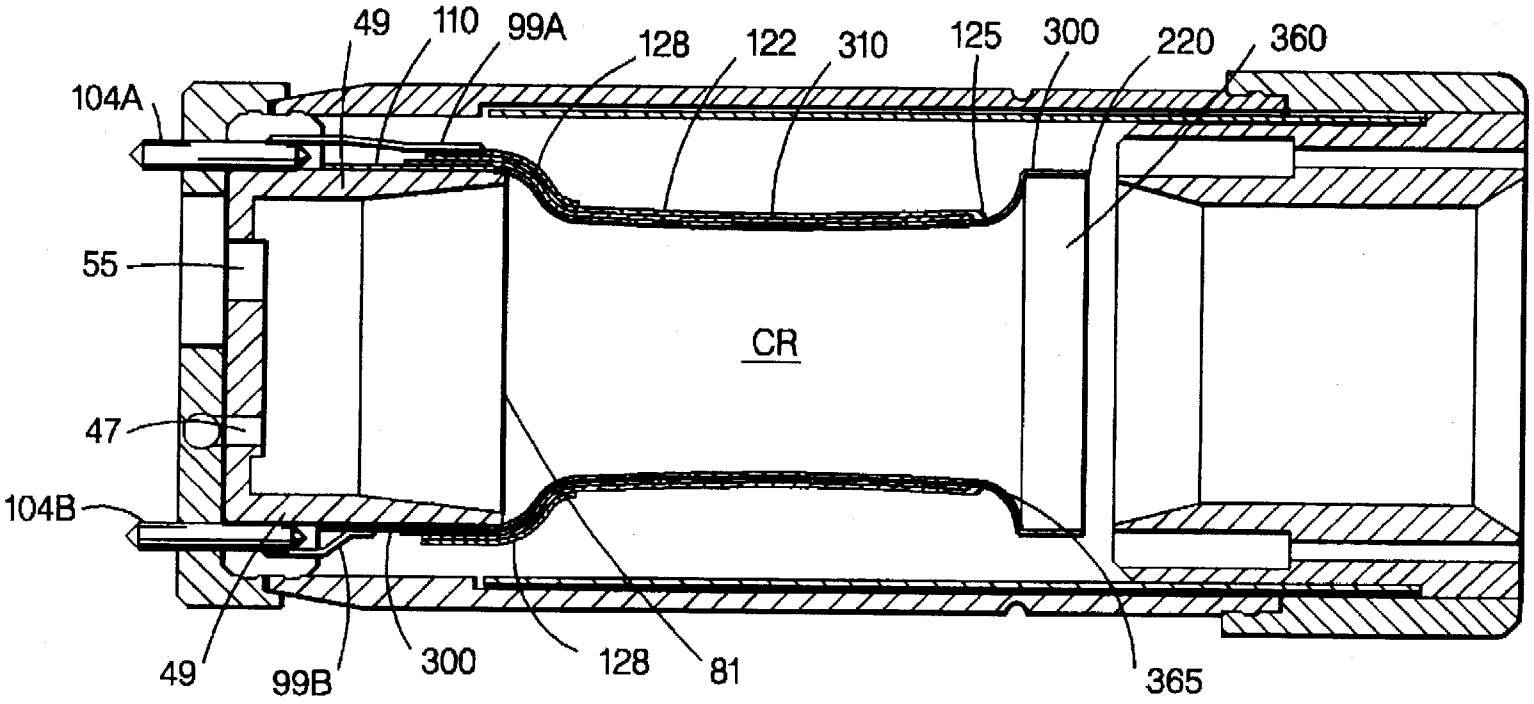
FIG. 3 is a side, cross-sectional view of a heater fixture according to the present invention.

A substantially cylindrical heating fixture 39 for heating the cigarette 23, and, preferably, for holding the cigarette in place relative to the lighter 25, and electrical control circuitry 41 for delivering a predetermined amount of energy from the power source 37 to heating elements (not seen in FIGS. 1 and 2) of the heating fixture are preferably disposed in the front 33 of the lighter. As described in greater detail below, a generally circular, terminal end hub 110 is fixed, e.g., welded, to be disposed within the interior of heater fixture 39, e.g., is fixed to spacer 49, as shown in FIG. 3. If the heater has two end hubs, either hub can serve as the fixed terminal end. In the presently preferred embodiment, the heating fixture 39 includes a plurality of radially spaced heating elements 122 supported to extend from the hub, seen in FIG. 3 and described in greater detail below, that are individually energized by the power source 37 under the control of the circuitry 41 to heat a number of, e.g., eight, areas around the periphery of the inserted cigarette 23. Eight heating elements 122 are preferred to develop eight puffs as in a conventional cigarette and eight heater elements also lend themselves to electrical control with binary devices. A desired number of puffs can be generated, e.g., any number between 5–16, and preferably 6–10 or 8 per inserted cigarette. As discussed below, the number of heaters can exceed the desired number of puffs/cigarette.

The circuitry 41 is preferably activated by a puff-actuated sensor 45, seen in FIG. 1, that is sensitive either to pressure drops that occur when a smoker draws on the cigarette 23. The puff-actuated sensor 45 is preferably disposed in the front 33 of the lighter 25 and communicates with a space inside the heater fixture 39 and near the cigarette 23 through a passageway extending through a spacer and a base of the heater fixture and, if desired, a puff sensor tube (not shown). A puff-actuated sensor 45 suitable for use in the smoking system 21 is described in U.S. Pat. No. 5,060,671, the disclosure of which is incorporated by reference, and is in the form of a Model 163PCO1D35 silicon sensor, manufactured by the MicroSwitch division of Honeywell, Inc., Freeport, Ill., which activates an appropriate one of the heater elements 122 as a result of a change in pressure when a smoker draws on the cigarette 23. Flow sensing devices, such as those using hot-wire anemometry principles, have also been successfully demonstrated to be useful for activating an appropriate one of the heater elements 122 upon detection of a change in air flow.

An indicator 51 is preferably provided on the exterior of the lighter 25, preferably on the front 33, to indicate the number of puffs remaining on a cigarette 23 inserted in the lighter. The indicator 51 preferably includes a seven-segment liquid crystal display. In a presently preferred embodiment, the indicator 51 displays the digit "8" for use with an eight-puff cigarette when a light beam emitted by a light sensor 53, seen in FIG. 1, is reflected off of the front of a newly inserted cigarette 23 and detected by the light sensor. The light sensor 53 is preferably mounted, in an opening in the spacer and the base of the heater fixture 39. The light sensor 53 provides a signal to the circuitry 41 which, in turn, provides a signal to the indicator 51. For example, the display of the digit "8" on the indicator 51 reflects that the preferred eight puffs provided on each cigarette 23 are available, i.e., none of the heater elements 43 have been activated to heat the new cigarette. After the cigarette 23 is fully smoked, the indicator displays the digit "0". When the cigarette 23 is removed from the lighter 25, the light sensor 53 does not detect the presence of a cigarette 23 and the indicator 51 is turned off. The light sensor 53 is modulated so that it does not constantly emit a light beam and provide an unnecessary drain on the power source 37. A presently preferred light sensor 53 suitable for use with the smoking system 21 is a Type OPR5005 Light Sensor, manufactured by OPTEX Technology, Inc., 1215 West Crosby Road, Carrollton, Tex. 75006.

As one of several possible alternatives to using the above-noted light sensor 53, a mechanical switch (not shown) may be provided to detect the presence or absence of a cigarette 23 and a reset button (not shown) may be provided for resetting the circuitry 41 when a new cigarette is inserted in the lighter 25, e.g., to cause the indicator 51 to display the digit "8", etc. Power sources, circuitry puff-actuated sensors, and indicators useful with the smoking system 21 of the present invention are described in U.S. Pat. No. 5,060,671 and U.S. patent application Ser. No. 07/943,504, both of which are incorporated by reference. The passageway and the opening 50 in the spacer and the heater fixture base are preferably air-tight during smoking.

A presently preferred cigarette 23 for use with the smoking system 21 will now be described and is shown in greater detail in parent application Ser. No. 08/118,665, although the cigarette may be in any desired form capable of generating a flavored tobacco response for delivery to a smoker when the cigarette is heated by the heating elements 122. Referring to FIG. 2, the cigarette 23 includes a tobacco web 57 formed of a carrier or plenum 59 which supports tobacco flavor material 61, preferably including tobacco. The tobacco web 57 is wrapped around and supported by a cylindrical back-flow filter 63 at one end and a cylindrical first free-flow filter 65 at an opposite end. The first free-flow filter 65 is preferably an "open-tube" type filter having a longitudinal passage 67 extending through the center of the first free-flow filter and, hence, provides a low resistance to draw or free flow.

If desired, cigarette overwrap paper 69 is wrapped around the tobacco web 57. Types of paper useful as the overwrap paper 69 include a low basis weight paper, preferably a paper with a tobacco flavor coating, or a tobacco-based paper to enhance the tobacco flavor of a flavored tobacco response. A concentrated extract liquor in full or diluted strength may be coated on the overwrap paper 69. The overwrap paper 69 preferably possesses a minimal base weight and caliper while providing sufficient tensile strength for machine processes. Presently preferred characteristics of a tobacco-based paper include a basis weight (at 60% relative humidity) of between 20–25 grams/m$^2$, minimum permeability of 0–25 CORESTA (defined as the amount of air, measured in cubic centimeters, that passes through one square centimeter of material, e.g., a paper sheet, in one minute at a pressure drop of 1.0 kilopascal), tensile strength ≧2000 grams/27 mm width (1 in/min), caliper 1.3–1.5 mils, $CaCO_3$ content <5%, citrate 0%. Materials for forming the overwrap paper 69 preferably include≧75% tobacco-based sheet (non-cigar, flue- or flue-/air-cured mix filler and: bright stem). Flax fiber in amounts no greater than that necessary to obtain adequate tensile strength may be added. The overwrap paper 69 can also be conventional flax fiber paper of basis weight 15–20 g/m$^2$ or such paper with an extract coating. Binder in the form of citrus pectin may be added in amounts less than or equal to 1%. Glycerin in amounts no greater than necessary to obtain paper stiffness similar to that of conventional cigarette paper may be added.

The cigarette 23 also preferably includes a cylindrical mouthpiece filter 71, which is preferably a conventional RTD-type (Resistance To Draw) filter, and a cylindrical second free-flow filter 73. The mouthpiece filter and the second free-flow filter are secured to one another by tipping paper 75. The tipping paper 75 extends past an end of the second free-flow filter 73 and is attached to the overwrap paper 69 to secure an end of the first free-flow filter 65 in position adjacent an end of the second free-flow filter 73. Like the first free-flow filter 65, the second free-flow filter 73 is preferably formed with a longitudinal passage 77 extending through its center. The back-flow filter 63 and the first free-flow filter 65 define, with the tobacco web 57, a cavity 79 within the cigarette 23.

It is preferred that the inside diameter of the longitudinal passage 77 of the second free-flow filter 73 be larger than the inside diameter of the longitudinal passage 67 of the first free-flow filter 65. Presently preferred inside diameters for the longitudinal passage 67 are between 1–4 mm and for the longitudinal passage 77 are between 2–6 mm. It has been observed that the different inside diameters of the passages 67 and 77 facilitates development of a desirable mixing or turbulence between the aerosol developed from the heated tobacco flavor material and air drawn in from outside the cigarette 23 during drawing on the cigarette, resulting in an improved flavored tobacco response and facilitating exposure of more of an end of the mouthpiece filter 71 to the mixed aerosol. The flavored tobacco response developed by heating the tobacco flavor material 61 is understood to be primarily in a vapor phase in the cavity 79 and to turn into a visible aerosol upon mixing in the passage 77. In addition to the above-described first free-flow filter 65 having a longitudinal passage 67, other arrangements capable of generating the desired mixing of the vapor phase flavored tobacco response with introduced air include those in which a first free-flow filter is provided in the form of a filter having a multitude of small orifices, i.e., the first free-flow filter may be in the form of a honeycomb or a metal plate having multiple holes formed therein.

Air is preferably drawn into the cigarette 23 predominantly through the tobacco web 57 and the overwrap paper 69, in a transverse or radial path, and not through the back-flow filter 63 in a longitudinal path. It is desirable to permit air flow through the back-flow filter 63 during a first puff on the cigarette to lower the RTD. It is presently understood that drawing air into the cigarette 23 longitudinally tends to result in the aerosol developed by heating the tobacco web with the heater elements 122 arranged radially around the tobacco web not being properly removed from the cavity 79. It is presently preferred to produce a flavored tobacco response as a function almost entirely of the makeup of the tobacco web 57 and the energy level of the heater elements 122. Accordingly, the portion of the air flow through the cigarette resulting from longitudinal flow through the backflow filter 63 is preferably minimal during smoking, except during the first puff. Further, the back-flow filter 63 preferably minimizes the flow of aerosol in a backward direction out of the cavity 79 after heating of the tobacco flavor material 61, so that the potential for damage to components of the lighter 25 from aerosol flowing backward from the cigarette 23 is minimized.

The carrier or plenum 59 which supports the tobacco flavor material provides a separation between the heating elements 122 and the flavor material, transfers heat generated by the heater elements to the flavor material, and maintains cohesion of the cigarette after smoking. Preferred carriers 59 include those composed of a non-woven carbon fiber mat, preferred because of its thermal stability. Such carriers are discussed in greater detail in U.S. patent application Ser. No. 07/943,504 and copending commonly-assigned U.S. patent application Ser. No. 07/943,747, filed Sep. 11, 1992, which are incorporated by reference.

Other carriers 59 include low mass, open mesh metallic screens or perforated metallic foils. For example, a screen having a mass in the range from about 5 g/m$^2$ to about 15 g/m$^2$ and having wire diameters in the range from about 0.038 mm (about 1.5 mils) to about 0.076 mm (about 3.0 mils) is used. Another embodiment of the screen is formed of a 0.0064 mm (about 0.25 mil)-thick foil (e.g., aluminum) having perforations with diameter in the range from about 0.3 mm to about 0.5 mm, to reduce the mass of the foil by about 30 percent to about 50 percent, respectively. Preferably, the perforation pattern of such a foil is staggered or discontinuous. (i.e., not in straight arrangement) to reduce the lateral conduction of heat away from the tobacco flavor material 61. Such metallic screens and foils are incorporated into a cigarette 23 in a variety of ways including, for example, (1) casting a tobacco flavor slurry on a belt and overlaying the screen or foil carrier on the wet slurry prior to drying, and (2) laminating the screen or foil carrier to a tobacco flavor base sheet or mat with a suitable adhesive.

A presently preferred tobacco web 57 is formed using a paper making-type process. In this process, tobacco strip is washed with water. The solubles are used in a later coating step. The remaining (extracted) tobacco fiber is used in the construction of a base mat. Carbon fibers are dispersed in water and sodium alginate is added. Any other hydrocolloid which does not interfere with the flavored tobacco response, is water soluble, and has a suitable molecular weight to impart strength to the tobacco web 57 may be added in lieu of the sodium alginate. The dispersion is mixed with the slurry of extracted tobacco fibers and optional flavors. The resultant mixture is wet-laid onto a fourdrinier wire and the web is passed along the remainder of a traditional paper making machine to form a base web. The solubles removed by washing the tobacco strip are coated onto one side of the base web, preferably by a standard reverse roll coater located after a drum or Yankee dryer. The tobacco solubles/tobacco dust or particulate ratio is preferably varied between a 1:1 and a 20:1 ratio. The slurry may also be cast or extruded onto the base mat. Alternatively, the coating step is produced off-line. During or after the coating step, flavors that are conventional in the cigarette industry are added. Pectin or another hydrocolloid is added, preferably in a range of between 0.1 to 2.0%, to improve the coatability of the slurry.

Whichever type of carrier 59 is used, tobacco flavor material 61 which is disposed on the inner surface of the harrier liberates flavors when heated and is able to adhere to the surface of the carrier. Such materials include continuous sheets, foams, gels, dried slurries, or dried spray-deposited slurries, which preferably, although not necessarily, contain tobacco or tobacco-derived materials, and which are more fully discussed in the above-incorporated U.S. patent application Ser. No. 07/943,747.

Preferably, a humectant, such as glycerin or propylene glycol, is added to the tobacco web 57 during processing in amounts equalling between 0.5% and 10% of humectant by the weight of the web. The humectant facilitates formation of a visible aerosol by acting as an aerosol precursor. When a smoker exhales an aerosol containing the flavored tobacco response and the humectant, the humectant condenses in the atmosphere, and the condensed humectant provides the appearance of conventional cigarette smoke.

The cigarette 23 is preferably a substantially constant diameter along its length and, like conventional cigarettes, is preferably between approximately 7.5 mm and 8.5 mm in diameter so that a smoker has a similar "mouth feel" with the smoking system 21 as with a conventional cigarette. In the presently preferred embodiment, the cigarette 23 is 58 mm in length, overall, thereby facilitating the use of conventional packaging machines in the packaging of such cigarettes. The combined length of the mouthpiece filter 71 and the second free-flow filter 73 is preferably 30 mm. The tipping paper 75 preferably extends 5 mm past the end of the second free-flow filter 73 and over the tobacco web 57. The length of the tobacco web 57 is preferably 28 mm. The tobacco web 57 is supported at opposite ends by the back-flow filter 63 which is preferably 7 mm in length, and the first free-flow filter 65, which is preferably 7 mm in length. The cavity 79 defined by the tobacco web 57, the back-flow filter 63, and the first free-flow filter 65 is preferably 14 mm in length.

When the cigarette 23 is inserted in the orifice 27 in the first end 29 of the lighter 25, it abuts or nearly abuts an inner bottom surface 81 of the spacer 49 of the heater fixture at hub 110, seen in FIG. 3, adjacent the passageway 47 communicating with the puff-actuated sensor 45 and the opening 55 for the light sensor 53. In this position, the cavity 79 of the cigarette 23 is preferably adjacent the heater blades 120 and substantially all of that portion of the cigarette including the second free-flow filter 73 and the mouthpiece filter 71 extends outside of the lighter 25. Portions of the heater blades 120 are preferably biased radially inward to facilitate holding the cigarette 23 in position relative to the lighter 25 and so that they are in a thermal transfer relationship with the tobacco web 57, either directly or through the overwrap paper 69. Accordingly, the cigarette 23 is preferably compressible to facilitate permitting the heater blades 120 to press into the sides of the cigarette. The remaining elements of heater fixture 39 are identical to these described in the parent application Ser. No. 07/943,504.

Air flow through the cigarette 23 is accomplished in several ways. For example, in the embodiment of the cigarette 23 shown in FIG. 2, the overwrap paper 69 and the tobacco web 57 are sufficiently air permeable to obtain a desired RTD such that, when a smoker draws on the cigarette, air flows into the cavity 79 transversely or radially through the overwrap paper and the tobacco web. As noted above, an air-permeable back-flow filter 69 may be used to provide longitudinal air flow into the cavity 79.

If desired, transverse air flow into the cavity 79 is facilitated by providing a series of radial perforations (not shown) through the overwrap paper 69 and the tobacco web 57 in one or more regions adjacent the cavity. Such perforations have been observed to improve the flavored tobacco response and aerosol formation. Perforations having a density of approximately 1 hole per 1–2 square millimeters and a hole diameter of between 0.4 mm and 0.7 mm are provided through the tobacco web 57. This results in preferred CORESTA porosity of between 100–500. The overwrap paper 69, after perforation, preferably has a permeability of between 100 and 1000 CORESTA. Of course, to achieve desired smoking characteristics, such as resistance to draw, perforation densities and associated hole diameters other than those described above may be used.

Transverse air flow into the cavity 79 is also facilitated by providing perforations (not shown) through both the overwrap paper 69 and the tobacco web 57. In forming a cigarette 23 having such perforations, the overwrap paper 69 and the tobacco web 57 are attached to one another and then perforated together or are perforated separately and attached to one another such that the perforations in each align or overlap.

Presently preferred heater embodiments are show in FIGS. 3–14. These heaters provide improved mechanical strength for the repeated insertions, adjustments and removals of cigarettes 23 and significantly reduce the escape of aerosols from a heated cigarette to decrease exposure of sensitive components to condensation. If provisions are not made to control condensation, the generated aerosols will tend to condense on relatively cool surfaces such as heater pins 99A and 99B, heater hub 110, the outer sleeve, electrical connections, control and logic circuitry, etc., potentially degrading or disabling the smoking article. It has been found that the generated aerosols tend to flow radially inward away from a pulsed heater.

Generally, there are preferably eight heater blades 120 to provide eight puffs upon sequential firing of the heater elements 122, thereby simulating the puff count of a conventional cigarette, and correspondingly eight barrier blades 220. Specifically, the heater blades 120 and the barrier blades 220 extend between opposite end hubs 110 and 210 are respectively interposed or interdigitated to form a cylindrical arrangement of alternating heater and barrier blades. Preferably, a gap 130, 135 is defined between each adjacent heater blade 120 and barrier blade 220.

As particularly shown in FIGS. 3–5, metal substrate 300 in the form of a cylindrical tube is provided for the heater since metal is more flexible, has better loading tolerances than a ceramic and, as discussed below is electrically conductive. The metal selected for substrate 300 is mechanically strong to be shaped as described below and is a thermally stable metal or alloy. Examples of appropriate metals include NiCr alloys, Haynes® 214 alloy (discussed in greater detail below) and Inconel 625 alloy sheet. The metal tube, and thus the substrate 300, can be made from an alloy in the form of a sheet, rod or bar, e.g., by drawing. Preferably, the metal tube is constructed from a nickel aluminide ($Ni_3Al$)alloy. Alternatively, another alloy of nickel and iron or an iron aluminide alloy ($Fe_3Al$) could be employed. As discussed below, the substrate 300 is fabricated such that it is approximately 3–5 mils thick.

The metal substrate is fabricated such that it preferably has a generally tubular or cylindrical shape. As best seen in FIG. 4, a tube 350 is provided having a generally circular open insertion end 360 having a throat 365 which directs the inserted cigarette toward the coaxially defined cylindrical receptacle CR having a diameter which is less than end 360. Insertion end 360 preferably has a diameter which is greater than the inserted cigarette 23 to guide the cigarette towards the receptacle CR, and the receptacle CR has a diameter approximately equal to cigarette 23 to ensure a snug fit for a good transfer of thermal energy. Given acceptable manufacturing tolerances for cigarette 23, a gradually narrowing area or throat 365 in the transition between the distal end and the receptacle CR can also serve to slightly compress the cigarette to increase the thermal contact with the surrounding substrate 300 serving as a inner wall of the receptacle. The blades. 120 are preferably bowed inward to increase thermal contact with the cigarette by constricting the diameter of the cylindrical receptacle. The opposite end of the tube defines terminal hub 110 having any appropriate diameter. As seen in FIG. 4, the layers 300 are arranged to define the round hub 210. Alternatively, the layers. 300 could continue to flare outward as an extension of the curvature of throat 365. A separate hub 210 is inserted in this flared opening. Alternatively or additionally, the layer 300 could be similarly formed with a separate hub 110 in electrical contact therewith to form a common.

A ceramic layer 310 is deposited on the metal tube to electrically insulate a subsequently applied electrical heater 122 from the metal tube substrate 300 except for a ring or hub 110 located at one end of the tube. The ceramic preferably has a relatively high dielectric constant. Any appropriate electrical insulator can be employed such as alumina, zirconia, mulite, corderite, spinel, fosterite, combinations thereof, etc. Preferably, zirconia or another ceramic is employed having a thermal coefficient of expansion which closely matches that of the underlying metal tube to avoid differences in expansion and contraction rates during heating and cooling, thereby avoiding cracks and/or delaminations during operation. The ceramic layer remains physically and chemically stable as the heater element is heated. A thickness of, e.g., approximately 0.1 to 10 mils, or approximately 0.5–6 mils, and more preferably 1–3 mils, is preferred for the electrical insulator.

Figure 9:
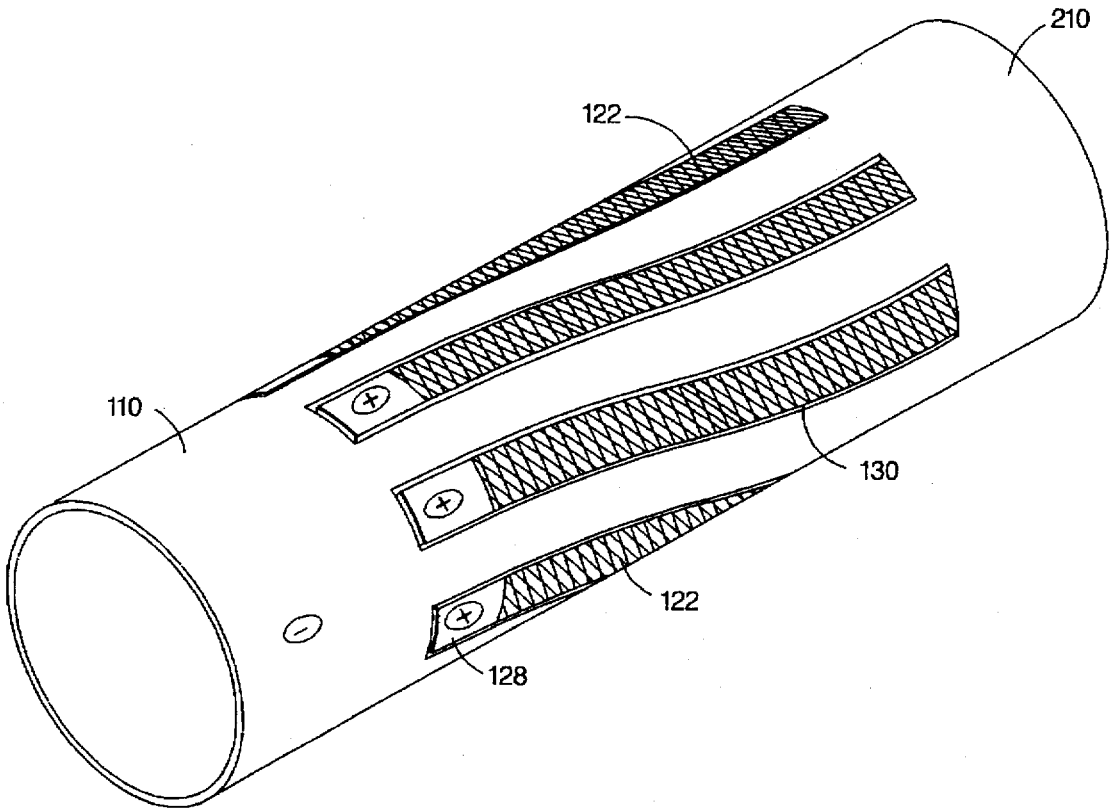
FIG. 9 is a perspective view of tubular heater having spiralled, gaps.

Gaps 130 and 135 are provided through the substrate 300, and any overlying layers, to thermally and electrically isolate adjacent heater elements. The gaps 130 can extend parallel with respect to the tube longitudinal axis and the gaps 135 can extend transversely. Alternatively, as shown in FIG. 9, the gaps can spiral along the cylindrical tube. Any desired spiralling can be employed subject to the conditions that respective gaps do not intersect and the areas bounded by gaps are substantially equal to define approximately equal areas which thermally contact the inserted cigarette for heating requirements and uniformly generated puffs. A helical gap path may be defined over an integral number of half turns, e.g. 2, of the cylinder. Spiral gaps offer the advantage of heating only a small segment of the longitudinally extending glue line of the cigarette. If longitudinally extending gaps are used, one heated area will likely be aligned with the glue, possibly generating subjectively undesirable flavors.

A preferred method of fabrication will now be described. A cylindrical tube of the selected metal having an appropriate length and a wall thickness of approximately 1–10 mils, and preferably 3–5 mils, is formed into the desired geometrical shape. The mass of the tube decreases as the thickness decreases, resulting in a lighter unit and decreasing the energy required to adequately heat the heater blades 120 and inserted cigarette, which further reduces the weight of the unit since the power source, e.g., batteries, can be smaller.

Two embodiments are preferred and differ in the sequence of the steps of applying the ceramic coating and forming the blades. In the first embodiment, (1) the tube is formed by, e.g., stamping or extrusion; (2) the ceramic and heater layers are deposited; (3) the blades are formed by, e.g., laser cutting; and (4) the heater and electrical leads are bonded. These steps are described in greater detail below. In the second embodiment, (1) the tube is formed by, e.g., stamping or extrusion; (2) the blades are formed by, e.g., stamping, EDM, or laser cutting; (3) the ceramic layer and heater layers are deposited; and (4) the heater and electrical leads are bonded. The second embodiment permits formation of the blades by stamping which avoids undesired burrs caused by laser cutting. This stamping is possible because the ceramic layer is not yet applied. In the first embodiment the heater blades 120 can be formed by cutting through the ceramic layer and underlying metal substrate by, e.g., laser cutting. Alternatively, a metal sheet is stamped to form blades prior to stamping a round sheet to form the tube or rolling a sheet into a tube, and performing shared steps (3) and (4), above. Alternatively, a thin tubing having, e.g., 3 to 5 mil thick walls, is provided with an adequate initial diameter. The tube is cut into desired lengths to subsequently form substrates. Next, conventional swaging techniques are performed to form the desired geometry and size of the substrate and hub(s). Subsequent steps are performed as described to form the heater blades. As is known, appropriate maskings are applied prior to performing each of the steps of heater and ceramic deposition to define areas of application. The fabrication of steps defined herein may be performed in any desired order to achieve manufacturing speeds, materials savings, etc.

Figure 4:
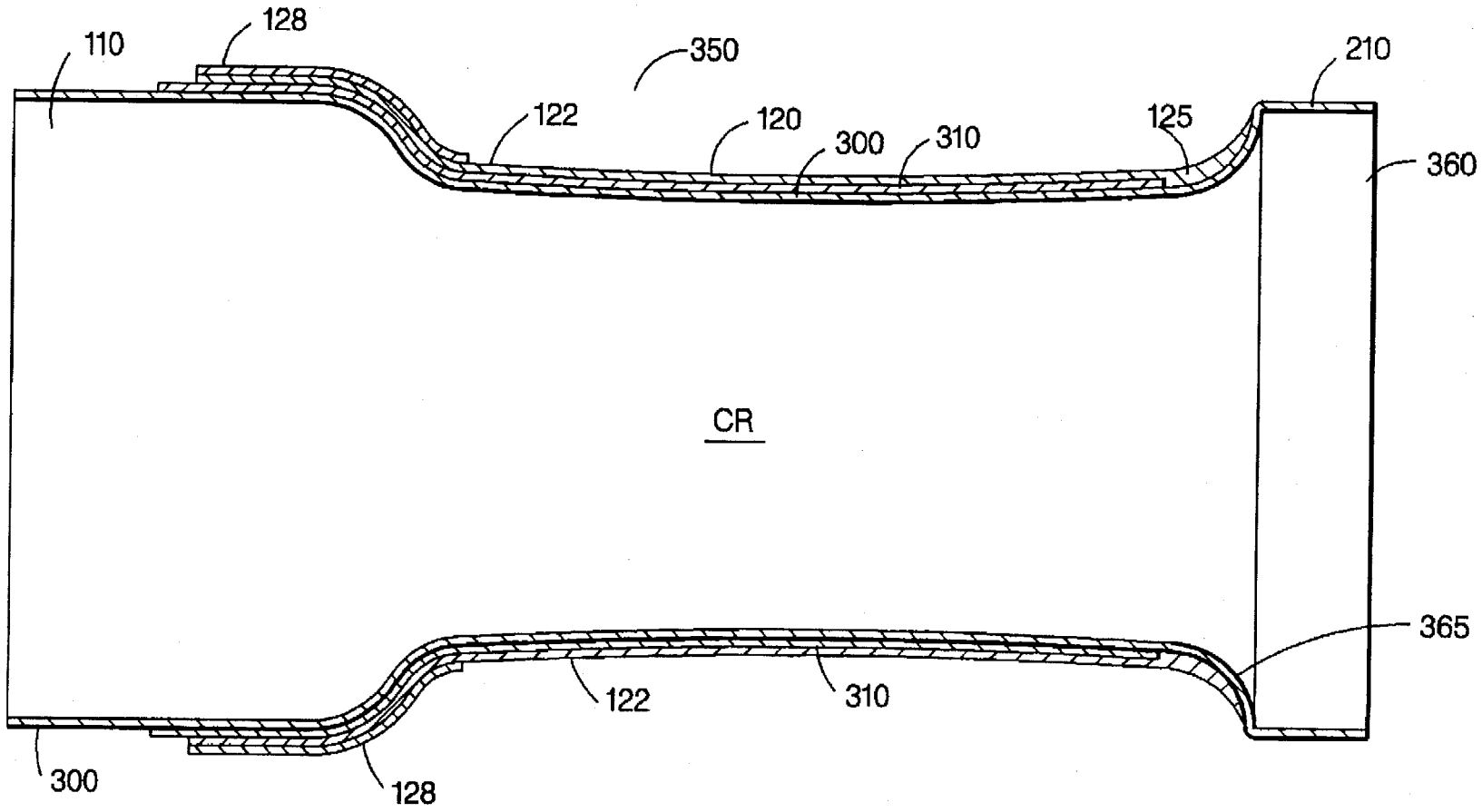
FIG. 4 is an exposed side view of a tubular heater according to the present invention.

For example, a heater deposited on a 3 mil thick tube as shown in FIG. 4 was constructed as described and was pulsed with approximately 22 to 23 Joules of energy. The heater blade reached temperatures between approximately 800° and 900° C. For example, the tube is preferably stamped or constricted to define a flared distal end 360 and hub 110 and a narrower waist section which ultimately defines the cylindrical receptacle CR. The slots are formed through the tube to define thermally and electrically insulating gaps 130, 135. These slots are preferably formed from the transition area between the insertion end hub 210 and the middle section defining the receptacle CR to the hub 110 and define blades. The gaps should extend a short distance beyond to applied ceramic layer 310 at hub 210 and also a short distance into common hub 110 beyond the ultimately applied heater. This distance should not be long enough to significantly weaken the hubs, e.g., approximately 0.5 mm is sufficient.

The slots can alternatively be cut by rotating the tube relative to a laser. Longitudinally extending slots are cut by relatively translating the laser and tube with respect to the longitudinal axis of the tube. Spiral slots are cut by rotating the tube relative to the laser and translating the laser relative with respect to the tube longitudinal axis. In addition to avoiding the cigarette glue line as discussed above, spiral slots formed by rotation possibly facilitate an in-line fabrication if the tube is also rotated and translated relative to a fixed laser.

The electrically insulating ceramic layer 310 is next applied to the tube except for terminal end 110 to permit leads to be applied. As noted above in the first embodiment, this application can precede formation of the blades. More specifically, an approximately 0.1 to 10 mils, and preferably 1–3 mils, layer of a ceramic such as zirconia, and particularly a partially-stabilized, zirconia with approximately 20%, and more preferably 8%, yttria, is thermally sprayed, by plasma coating if the surface is adequately rough, onto the tube which preferably is rotated during this deposition. Preferably, the tube is spun a number of times during coating to apply a proper coating. In addition, if present, the end hub 210 portion of substrate 300 is also not sprayed to provide a contact area for the heating element 122.

Preferably, the surface roughness of the metal layer 300 is increased to provide better adhesion with the deposited ceramic layer 310. The surface of an adequately thick layer 300 is first roughened by an appropriate technique such as grit blasting and then a bond coat is applied. The bond coat is a thin, e.g., 0.1 to 5 mil, and preferably 0.5 to 1.0 mil layer of a metallic coating such as FeCrAlY, NiCrAlY, NiCr, NiAl or $Ni_3Al$ and provides good bond interface between the roughened metal layer 300 and the subsequently applied ceramic layer 310.

Other deposition techniques are alternatively employed in addition to thermal spraying, and more particularly plasma spraying. For example, physical vapor deposition, chemical vapor deposition, thick film technology with screen printing of a dielectric paste and sintering, a sol-gel technique wherein a sol-gel is applied and then heated to form a solid, and chemical deposition followed by heating. A chemical type of bonding is preferred for the bonding strength.

This chemical bonding is achieved by heating the ceramic layer, or ceramic precursor, with the metal substrate at a relatively high temperature. Alternatively, the metal substrate is heated at a high temperature to form an oxide layer on the surface which performs similarly to the ceramic layer.

The heating element 122 is deposited next. Any appropriate metal or alloy, with or without intermetallic/ceramic additives, can be employed, in a powder form if required by the deposition technique. More specifically, an approximately 0.1 to 5 mil layer of an electrically resistive material such as NiCr alloy, $Ni_3Al$ alloy, NiAl alloy, $Fe_3Al$ alloy or FeCrAlY alloy is deposited by any known thermal spraying technique such as plasma coating or HVOF (High Velocity Oxy Fuel). The resistivity of the resistive material may be adjusted with the addition of suitable ceramics or by adjusting the oxidation level of the metal during plasma or HVOF spraying. Thin film techniques, e.g., CVD or PVD, can be used if the surface roughness of the ceramic layer, comprised of relatively large ceramic particles compared to the heater material, is smoothed by, e.g., diamond grinding to a surface roughness between 135 to 160 micro-inches Ra, with an average of 145 micro-inches Ra. With this technique a thinner layer of metal is required, resulting in a desired lower mass heater. However, the process is slower. Any metal such as platinum may be used. The heaters can be deposited as the ceramic-coated tube is spun.

Two preferred embodiments of the heater blade, which can be an individual discrete heater rather than a plurality of arranged heaters, will now be described. In the first embodiment, substrate 300 is a nickel aluminide ($Ni_3Al$); ceramic layer 310 is zirconia (ZnO), preferably partially stabilized with yttria, preferably with approximately 8%. yttria; and heating element 122 is thermally sprayed $Ni_3Al$ or NiAl. In the second embodiment, substrate 300 is an iron aluminide ($Fe_3Al$); ceramic layer 310 is zirconia, preferably partially stabilized with yttria, preferably with approximately 8% yttria; and heating element 122 is thermally sprayed $Fe_3Al$. If desired, alternative embodiments can employ the heating element material of one embodiment with the substrate material of another embodiment.

The preferred embodiment will now be discussed in greater detail with respect to the first embodiment employing nickel aluminide. This description is also applicable to the second embodiment employing iron aluminide. Preferably, the aluminum is between approximately 16 to 50 at. %, compared to less than 1 at. % in many commercial alloys.

Substrate 300 can be a pre-formed $Ni_3Al$ tube, a machined $Ni_3Al$ tube or a sheet of $Ni_3Al$. Substrate 300 can also be made by thermal spraying a pre-alloyed $Ni_3Al$ layer on carbon rods or tubes. Aluminum can also be used as a support for the substrate layer 300. Substrate 300 can also be made by feeding Ni and Al powders in an appropriate ratio to form $Ni_3Al$. When the powders are fed through plasma of a thermal spray gun, the powders will react to release a significant amount of heat. Alloying will take place when the resulting splat falls on the surface. The alloying effect can be enhanced by using mechanical alloyed powders of Ni and Al. A post-heat treatment will result in $Ni_3Al$ and an excellent bonding with the subsequently applied insulator layer 310.

Insulator 310 can be any electrical insulator which is electrically and thermally stable and adheres to the substrate 300. Thermal expansion mismatch between insulator 310 and both the substrate 300 and heater layer 122 should be taken into consideration. Any appropriate ceramic such as alumina can be used. Zirconia has been found to be extremely adherent in thermal barrier coatings and has been applied to different geometries, especially zirconia partially stabilized with approximately 8% yttria.

Since a high resistance is a desired property for electrical heating with portable batteries, thermal spraying is preferred to provide resistive heater layer 122. It can be sprayed using a variety of thermal spraying techniques. A pre-alloyed $Ni_3Al$, a mechanically alloyed $Ni_3Al$, or a powder of Ni and Al in the proper ratio can be used. A pre-heating step is needed if mechanically alloyed $Ni_3Al$ or if Ni and Al powders are used for spraying applications. Temperature and time for pre-heating will depend on the thermal spray gun parameters and can be adjusted to fall in the range of 600° C. to 1000° C. Particle sizes and size distributions are important to form $Ni_3Al$ if a pre-alloyed $Ni_3Al$ is not used.

For the purposes of a resistor, a composition of NiAl can be used. Several elements can be used as additions to the $Ni_3Al$ alloys B and Si are the principal additions to the alloy for heater layer 122. B is thought to enhance grain boundary strength and is most effective when the $Ni_3Al$ is nickel rich,. e.g., Al≦24 at. %. Si is not added to the $Ni_3Al$ alloys in large quantities since addition of Si beyond a maximum of 3 weight percent will form silicides of nickel and upon oxidation will lead to $SiO_x$. The addition of Mo improves strength at low and high temperatures. Zirconium assists in improving oxide spalling resistance during thermal cycling. Also, Hf can be added to improved high temperature strength. Preferred $Ni_3Al$ alloy for use as the substrate 300 and resistive heater 122 is designated IC-50 and is reported to comprise approximately 77.92% Ni, 21.73% A;. 0.34% Zr and 0.01% B in "Processing of Intermetallic Aluminides", V. Sikka, *Intermetallic Metallurgy and Processing Intermetallic Compounds*, ed. Stoloff et al., Van Nestrand Reinhold, N.Y., 1994, Table 4. Various elements cab be added to the iron aluminide. Possible additions include Nb, Cu, Ta, Zr, Ti, Mn, Si, Mo and Ni.

If melting of any alloy is required, preferably an argon gas cover is employed. Electrical leads can be brazed to the resistive heater 122 or substrate 300 as discussed using a YAG laser or $CO_2$ laser. Brazing can be accomplished with Ag-Cu or Ni-Cu braze alloys. Brazing is a preferred method over soldering and welding for these purposes since the thickness of resistor, is less than 5 mil. (0.005") or 125 min. A flux can be used to wet the surface and clean the oxides. Several such brazing alloys are available from Lucas-Milhaput of Wisconsin and from. Indium Corporation of America. Ag-Cu alloys have optimum solidus and liquidus temperatures for laser brazing of a heater without penetrating through the layers since the total thickness of the heater 122, insulator 310, substrate 300 is in the range of 10 to 15 mil.

The present invention provides a multi-layer heater with $Ni_3Al$ as a substrate and as a heater separated by an insulator, zirconia. The concept is generic and can be applied in different thickness to various geometries $Ni_3Al$ readily forms an adherent alumina layer on the surface. This alumina layer will prevent further oxidation and will eliminate spalling of oxides, thereby enhancing cycle life time of the material.

Figure 5:
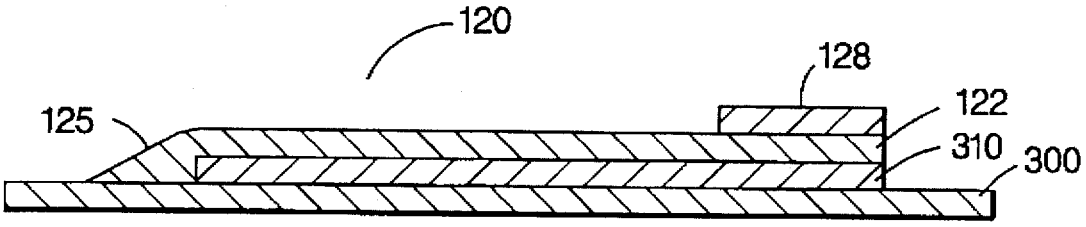
FIG. 5 is an exposed side view of a heater blade having a metal substrate.

As seen in FIGS. 4 and 5, an end of the deposited heater 122 is in intimate electrical contact with the underlying metal substrate 300 at a portion 125 and the remainder of heating element 122 overlies the ceramic insulating layer 310. Plasma coating of each resistive heating element 122 to the metal substrate 300 provides a strong contact. Accordingly, an electrical common is formed by the end hub 110 and the electrically conducting metal substrates 300 of each heater blade 120 which are connected to one end, e.g., the distal end, of each respective heater element. The hub 110 serving as a common is electrically connected to the power source via pin 99B, as shown in FIG. 3.

A material 128 having a high electrical conductivity, e.g., of nickel, nickel alloys, copper, or aluminum, is finally sprayed on heater element 120 and then leads, e.g., pins 99A, are then affixed, e.g., by welding, brazing or soldering, to the opposite end, e.g., the proximal end, of the heater element near hub 110. The material 128 can be integrally formed to leads or soldered, and preferably silver soldered, thereto in lieu of connecting pins 99A discussed below. The high conductive material 128 makes the underlying area less resistive and permits the leads to be more easily added as discussed.

Figure 6A:
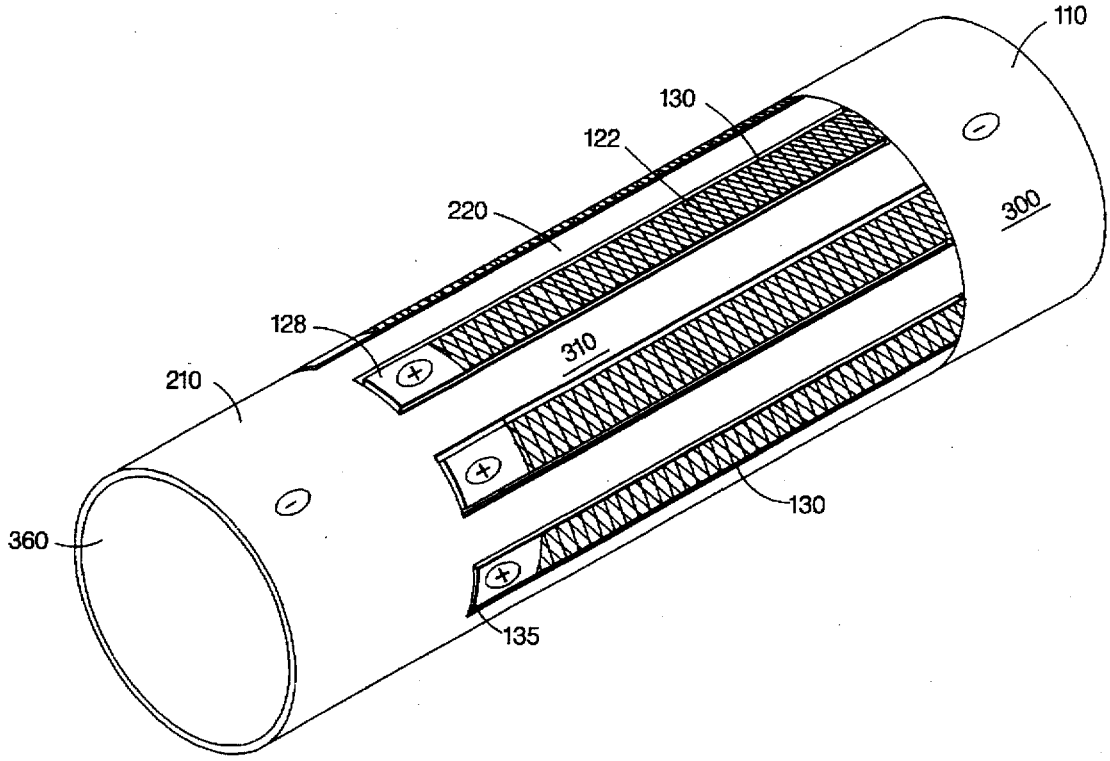
FIG. 6A is a perspective view of dual hubs having a plurality of alternating barrier and heater blades extending therebetween.
Figure 6B:
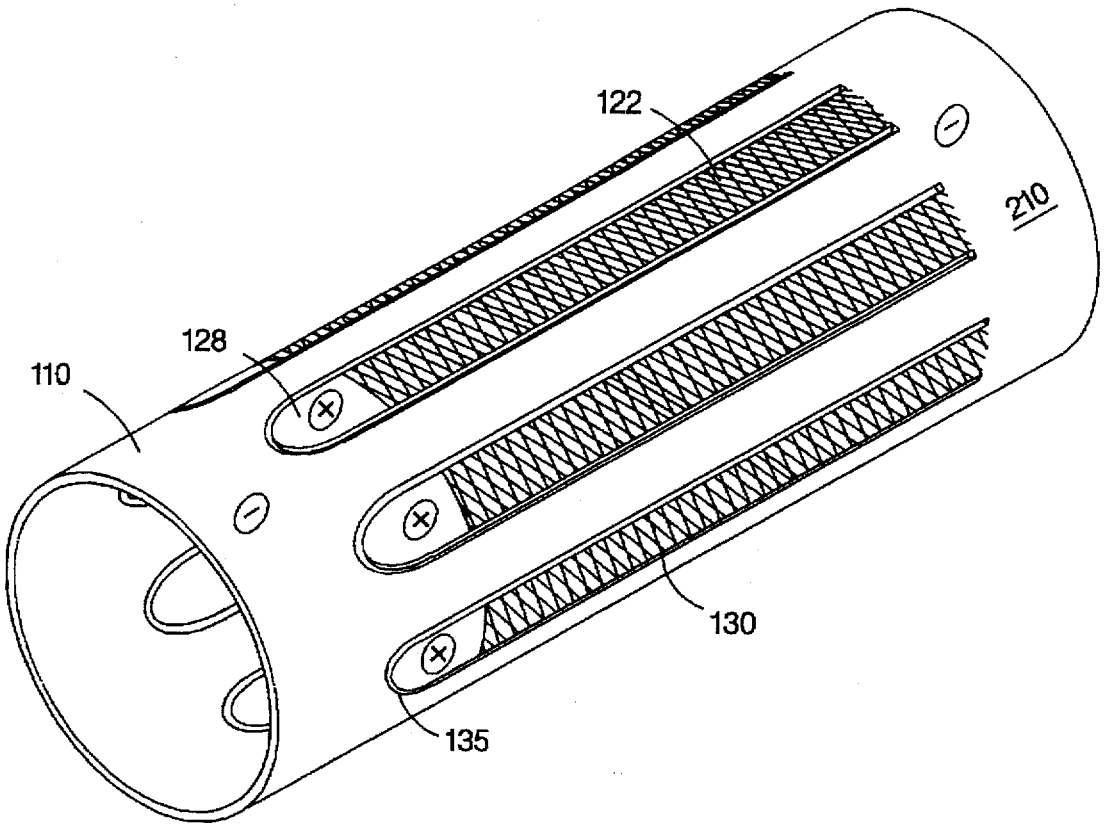
FIG. 6B is an embodiment similar to that of FIG. 6A except that the gaps between blades are shaped as an elongated U.
Figure 7:
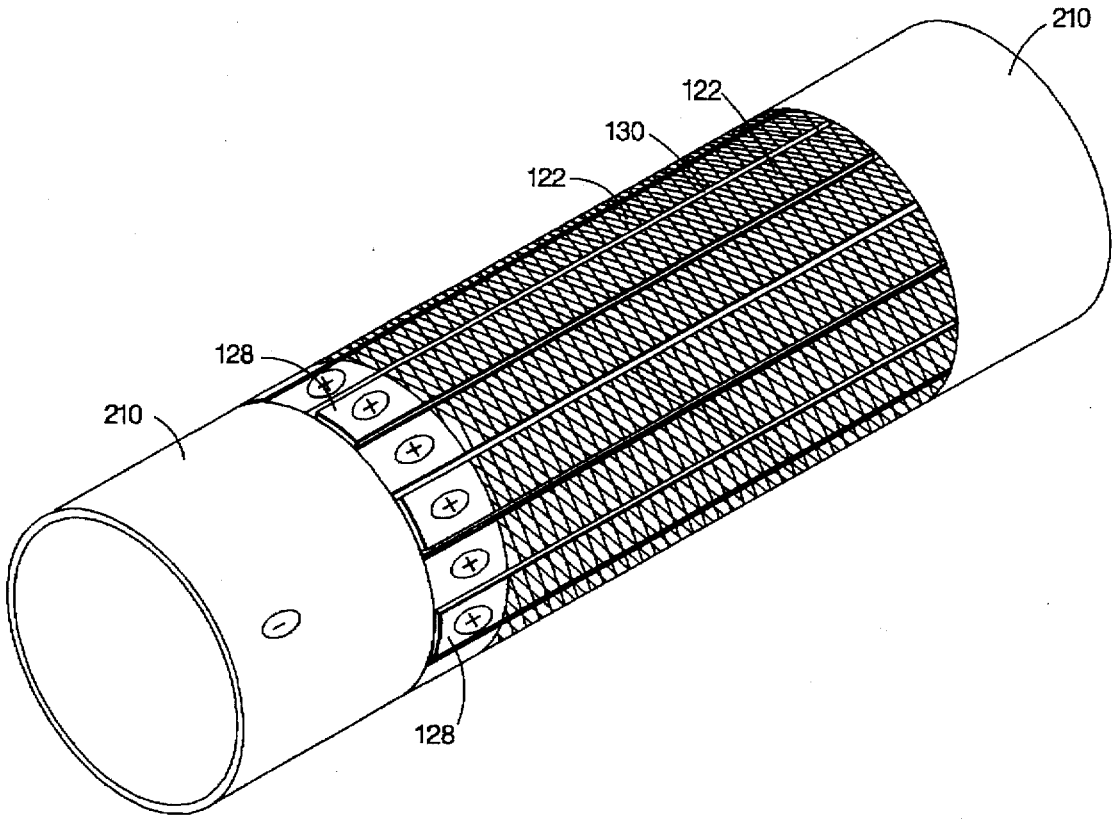
FIG. 7 is a perspective view of the embodiment depicted in FIG. 6A having heater elements deposited on every defined blade.
Figure 8:
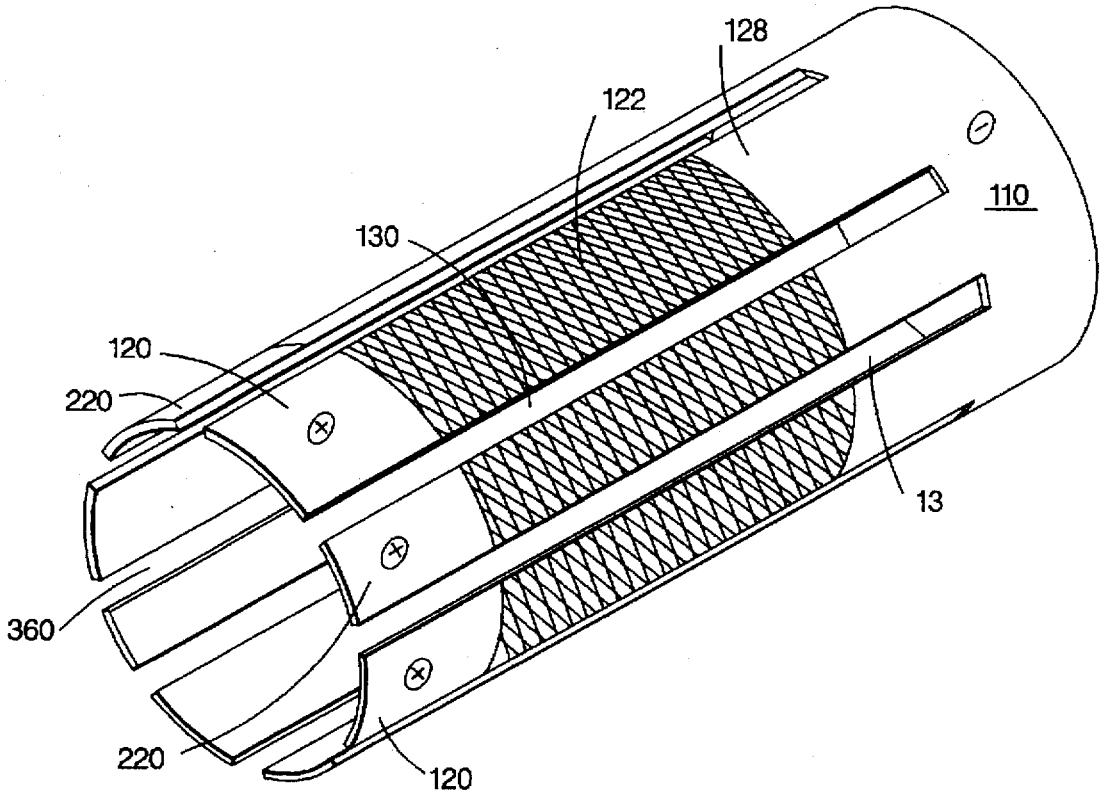
FIG. 8 is a perspective view of a heater having a single supporting hub.

The tube is cut either to have the single, metal hub 110 at one end as shown in FIG. 8 or preferably to provide an additional hub at the opposite end 210 as shown in FIGS. 6A–7. Since metal is used as the substrate, the heater blades 120 can be biased inwardly, preferably prior to adding layer 310 and any rolling, toward the inserted cigarette to improve propagation of heat, i.e., thermal contact, between these elements without risking fracture associated with ceramic blades. In addition, the formed blade, and the deposited heater, have a curvature as a section of the tube, further increasing contact with an inserted cylindrical cigarette. The blades can be, e.g., 1.5 mm. wide.

In one embodiment shown in FIGS. 6A and 6B, every other ceramic coated area or blade 120 bounded on opposite sides by a gap 135 of the tube has a heater element 122 deposited thereon. Accordingly, alternating blades 220 are formed which are interdigitated between alternating heater blade areas 120. These blade 220 function as barriers to prevent escape of vapors from the heated cigarette which could cause potentially damaging condensation. In such an embodiment, twice as many, e.g., sixteen, gaps as the number of desired puffs, e.g., eight, are provided to define an adequate and equal number of heater blades and non-heated, barrier blades.

It may be desired to change the number of puffs, and hence the number of heaters 122, achieved-when a cigarette is inserted into the cylindrical receptacle CR. This desired number is achieved by forming a desired number of heater blades 120 and associated barrier blades 220. This can be achieved by cutting the tube into equally or unequally sized blades.

As discussed, gaps 130, 135 are defined between each adjacent heater blade 120 and barrier blade 220. These gaps are formed by slightly cutting or shaving one or both set(s) of the barrier or heater blades. The gaps 130, 135 are sized to be large, or wide, enough to prevent heat loss during pulsing from a heated heater blade to adjacent barrier blades and small, or narrow, enough to prevent significant amounts of vapor escaping the cylindrical receptacle. For example, a gap of approximately 5–15 mil or less, and preferably approximately 3–4 mil, is appropriate in many applications.

After a heater element 122 is pulsed, there is a predetermined minimum time before a subsequent puff is permitted. During this predetermined or longer puff interval, the two barrier blades 220 adjacent the recently pulsed heater blade 120 also act as heat sinks to prevent heat from propagating to other heater blades 120 or to unheated or previously heated portions of the inserted cigarette 23. Premature heating of a portion of the cigarette could result in undesired and/or partial aerosol generation or heat-induced degradation of the cigarette portion prior to the desired heating. Subsequent reheating of a previously heated portion can result in undesired flavors and tastes being evolved. To achieve this heat sink function, the barrier blades preferably include a layer of thermally non-conductive material, i.e., a thermal insulator, such as a ceramic. Examples of suitable ceramics include alumina, zirconia, a mixture of alumina and zirconia, mulite, etc., as is the case with the heater blades.

If a longer puff is desired than is obtained by a pulsing of a single heater and associated heater blade, then the control logic is configured to fire another heater or additional heater(s) immediately after the pulsing of the initial heater, or during a final portion of the initial pulsing, to heat another segment of the cigarette. The additional heater can be a radially successive heater or another heater. The heater blades should be sized to obtain the total desired number of puffs of a desired duration.

In another embodiment, wherein the final heater is shown in FIG. 8, a tube comprises a single hub 110 having a plurality of, e.g., eight as shown, blades with respective gaps 130 therebetween. Alternate blades are deposited with heater elements 122 as described above to define heater blades 120, whereas the other interposed blades define barrier blades 220.

As shown in FIG. 7, all of the areas bounded by gaps can function as heater blades 120. In one embodiment, each ceramic coated portion or blades has a heater element 122 deposited thereon and the number of heater blades 120 corresponds to the number of desired puffs, e.g., eight. In another embodiment, each ceramic coated portion has a heater element 122, and the number of formed heater blades 120 is twice the number of puffs, e.g., there are sixteen portions with heaters for an eight puff cigarette. Such a configuration permits different firing sequences than the normal successive firing of approximately 2 seconds, and preferably the radially sequential firing sequence for an embodiment wherein the number of heating elements 122 corresponds to the puff count. For example, the logic circuit can dictate that two circumferentially opposite heater elements 122, i.e., heater elements separated by 180° on the tube, fire simultaneously to jointly heat an adequate amount of the cigarette to generate a puff. Alternatively, a first firing sequence of every other heater element 122 for a cigarette is followed by a second firing sequence of the intervening heater elements 122 for the next cigarette. Alternatively, this first firing sequence can be repeated for a predetermined life cycle of numerous cigarettes and then the second firing sequence initiated. Any combination of heater blades and, if desired, barrier blades can be employed. The number of heater blades can be less than, equal to, or greater than the number of puffs of a single employed cigarette. For example, a nine blade system can be employed for a six-puff cigarette, wherein a different set of six heaters is fired for each subsequent cigarette and the associated set of remaining three heaters is not fired.

The use of metal as the substrate permits the metal substrate 300 of each of the heater blades 120 to serve as the conducting path, e.g., the negative connection, for the heater element 122. More to specifically, one end of the heater element is electrically connected, e.g., by plasma spraying, to the underlying metal substrate at portion 125. Preferably, this heater end is nearer the open insertion end 360 than the other heater end since this heater connection does not involve electrical leads which could be damaged by insertion and removal of the cigarette. The metal hub 110 is provided with a negative charge from the power source 37 to serve as the common for, all of the heater elements. More specifically, hub 110 is electrically connected to the negative terminal of power source 37 via a pin 99B connected, and preferably welded, thereto as shown in FIG. 3. Pin 99B is in turn connected to the power source 37 via pin 104B. A conducting path is provided from the other end of each heater element 122 to the power source by, e.g., an electrical lead such as, pin 99A spot welded, brazed or soldered to area 128 of the heater elements 122. Pin 99A is electrically connected to the positive terminal of power source 37 via pin 104A. Area, 128 is comprised of any appropriate material such as nickel, aluminum or appropriate 50/50 alloys of nickel and aluminum, copper, etc. having good adhesion and lower melting points than metal layer 300.

The present invention also minimizes potentially damaging thermally induced stresses. The heater element is substantially uniformly deposited onto a ceramic support, thereby avoiding stresses arising from interconnections of discrete portions of a heater element and/or from discrete interconnections between the heater element and the ceramic.

As discussed, it is preferred to deposit the heater elements 122 onto the outer surface of the heater blade 120, i.e., the blade surface opposite the surface contacting or in thermal proximity to the inserted cigarette 23, to simplify fabrication. Also, by depositing the heater elements 122 on this outer surface a relatively robust support is formed for the heater elements and the heater elements avoid direct forceful interaction with the cigarette during insertion, any interim adjustments and removal by the smoker. Such an advantageous mechanical configuration requires that the heater element 122 heat the underlying ceramic layer 310 and metal substrate 300 contacting the inserted cigarette to transfer heat primarily via conduction to the inserted cigarette and secondarily via convection and radiation if a snug interface is not maintained between the pulsed heater blade 120 and the inserted cigarette. Preferably, the heater element 122 is sized and thermally designed to heat the majority of the underlying heater blade 120 to ultimately heat a segment of the inserted cigarette having sufficient size, e.g., 18 square mm, to generate an acceptable puff to the smoker. The heat transfer from the heater element 122 to the cigarette 23 should not suffer significant inefficiencies since the heater supplies a pulse of heat energy through relatively thin layers 300 and 310. The heater element 122 itself, depending on the material selected and the deposition technique, is between approximately 1 and 2 mils thick. The heater element can be the previously mentioned MCrAlY alloy, FeCrAly, Nichrome® (brand alloys 54–80% nickel, 10–20% chromium, 7–27% iron, 0–11% copper, 0–5% manganese, 0.3–4.6% silicon, and sometimes 1% molybdenum, and 0.25% titanium; Nichrome I is stated to contain 60%. nickel, 25% iron, 11% chromium, and 2% manganese; Nichrome II, 75% nickel, 22% iron, 11% chromium, and 2% manganese; and Nichrome III, a heat-resisting alloy containing 85% nickel and 15% chromium) or aluminides. Also, a ceramic layer having relatively low thermal conductivity will not conduct significant amounts of heat to its associated hub. A metal layer, though having a higher thermal conductivity than ceramic, will also not conduct significantly, e.g., greater than between approximately 5 and 10%, because of short pulse time and small cross-section.

It has been found that a primarily transverse or radial air flow relative to the inserted cigarette results in a more desirable smoke generation than a primarily longitudinal flow. The gaps 130 and 135provide pathways for air to be drawn into contact with the inserted cigarettes. Additional air passages are provided to optimize the transverse air flow by perforating sections of the heater blade and/or perforating the barrier blades. Perforation is preferably achieved by a laser after applying the ceramic coating 310 and heater coating 122 or by a mechanical perforator before application. To avoid patterning and perforating the heater blade prior to depositing the heater elements or perforating the heater blades after deposition, the barrier blades can be exclusively perforated if adequate air flow is achieved in conjunction with the gaps.

As discussed above, gaps 130, 135 are provided to avoid heating adjacent blades and to maximize vapor containment. In addition, these gaps permit for thermal expansion and contraction of the heater blades 120 and barrier blades 220. In the previously discussed embodiments employing a single hub (FIG. 8), the gaps 130, 135 are defined between the longitudinal sides of adjacent blades to compensate for temperature induced latitudinal changes. Longitudinal changes are permitted since the ends of the blades opposite the single hub are free. In the previously discussed dual hub embodiments, the gaps 130 and 135 are defined by an elongated, rectangular wave to provide gaps between longitudinal sides of adjacent blades and between the rounded or squared free blade ends and the opposing hub 210.

In the embodiment shown in FIG. 6A, wherein the gaps 130 extend only along the longitudinal sides of adjacent, interdigitated heater blades 120 and barrier blades 220 are bounded at both ends by the respective hubs 110 and 210. The hub 110 is not coated with a ceramic coating 310, i.e., metal substrate 300 is exposed, so that hub 110 function as a common for the heater elements 122. The hub 110 defines insertion opening 360, which is not flared in this embodiment. FIG. 6B shows a similar embodiment except that the gaps 135 define a U-shape. The barrier blades 220 are each integrally formed to both of the hubs 110 and 210 and the heater blades 120 extend from hub 110. Such a gap shape, wherein one end of the blade is free relative to the oppositely located hub, permits thermal expansion and contraction of the heater blades 120 in the longitudinal direction, thereby reducing stress.

A further embodiment is shown in FIG. 8 which does not have a hub 210 defining insertion opening 360. Insertion opening 360 is defined by free ends of heater blades 120 and barrier blades 220 extending longitudinally in the same direction from hub 110. Free blade ends permit the blades to expand to alleviate undesired excessive-inward bowing or biasing of the blades resulting from thermal expansion. Excessive inward biasing decreases the inner diameter of the cylindrical receptacle CR, thereby increasing the potentially damaging forces necessary to insert and remove the cigarette. Also, free blade ends advantageously reduce the required insertion forces since the free ends are cantilevered relative to the hub. In addition, as shown in this embodiment the widths of the heater and barrier blades need not be equal. Heater blade 120 is preferably approximately 1.5 mm wide in any embodiment.

Figure 10:
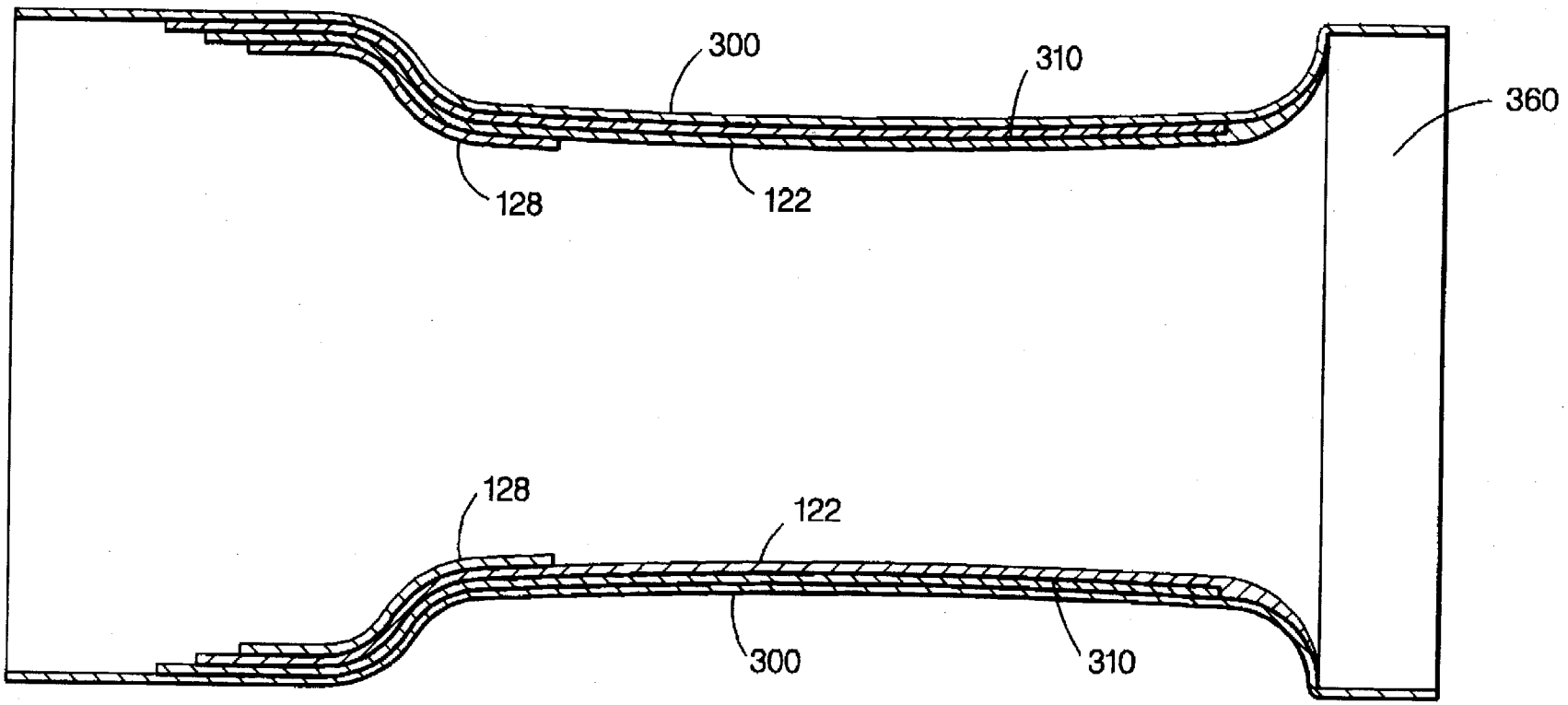
FIG. 10 is an exposed side view of a tubular heater having heater elements on inner faces of heater blades.

An alternative embodiment will now be discussed with reference to FIG. 10 wherein the heaters 122 are deposited on the inner side of the heater blade 120, i.e., on the surface defining the cylindrical receptacle CR, such that the heaters 122 directly contact or are in close proximity to the inserted cigarette. As seen, a ceramic layer 310 is located in the interior of metal layer 300 of the blade 120 and a heater 122 is located on the ceramic layer 310. The electrical interconnectors are as described above. Any of the disclosed embodiments can employ this heater positioning. A method of constructing such a configuration would involve forming the blades, applying ceramic and heater layers in any order discussed above on a metal sheet and then rolling and welding the closed shape to form a tube with the heaters 122 located on the inner side of the blade 120 facing the inserted cigarette.

Figure 11:
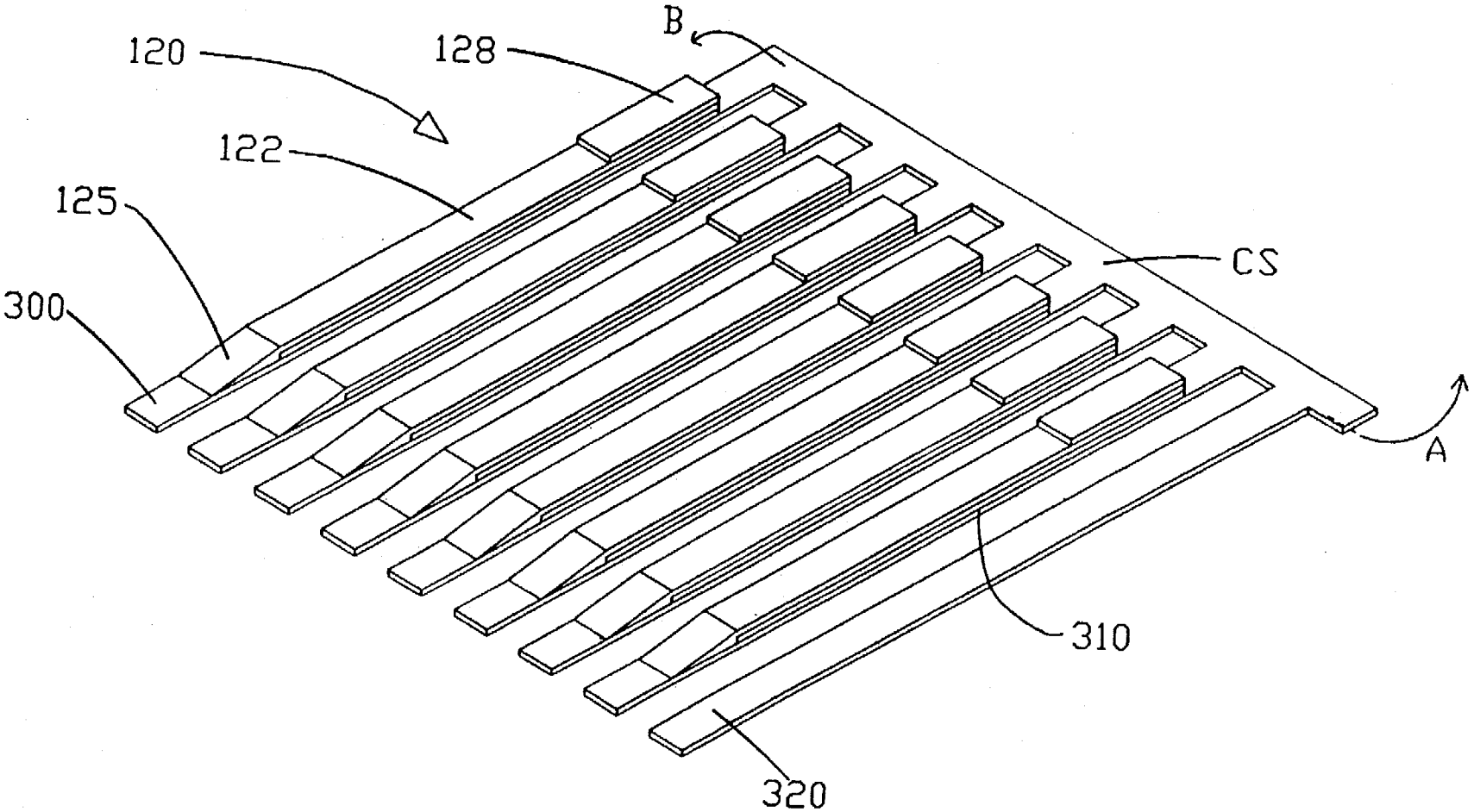
FIG. 11 is a perspective view of an arrangement of heater blades prior to rolling.

More specifically, this fabrication technique includes stamping an appropriate metal sheet to form a plurality of blades 120,220 (if barrier blades 220 are employed) extending perpendicularly from a connecting section CS in a comb-like arrangement, as shown in FIG. 11. This arrangement is masked and an insulative ceramic layer applied to the unmasked blades and, if desired, to connecting section CS. Next, the arrangement is masked again and a resistive heats element 122 applied, e.g., by screen printing, to selected blades. The connecting leads are then-attached. The heater arrangement is then rolled such that the connecting section CS forms an electrical common hub 110 as discussed. When the connecting section CS is rolled in direction A, a cylindrical heater arrangement is formed wherein the heaters 122 directly face the inserted: cigarette as shown in FIG. 10, or when rolled in direction B, a cylindrical heater arrangement is formed wherein the heaters face outwardly from the cigarette, i.e., the metal substrate 300 directly faces the cigarette, as shown in the other FIGS., e.g., FIG. 12.

Figure 13:
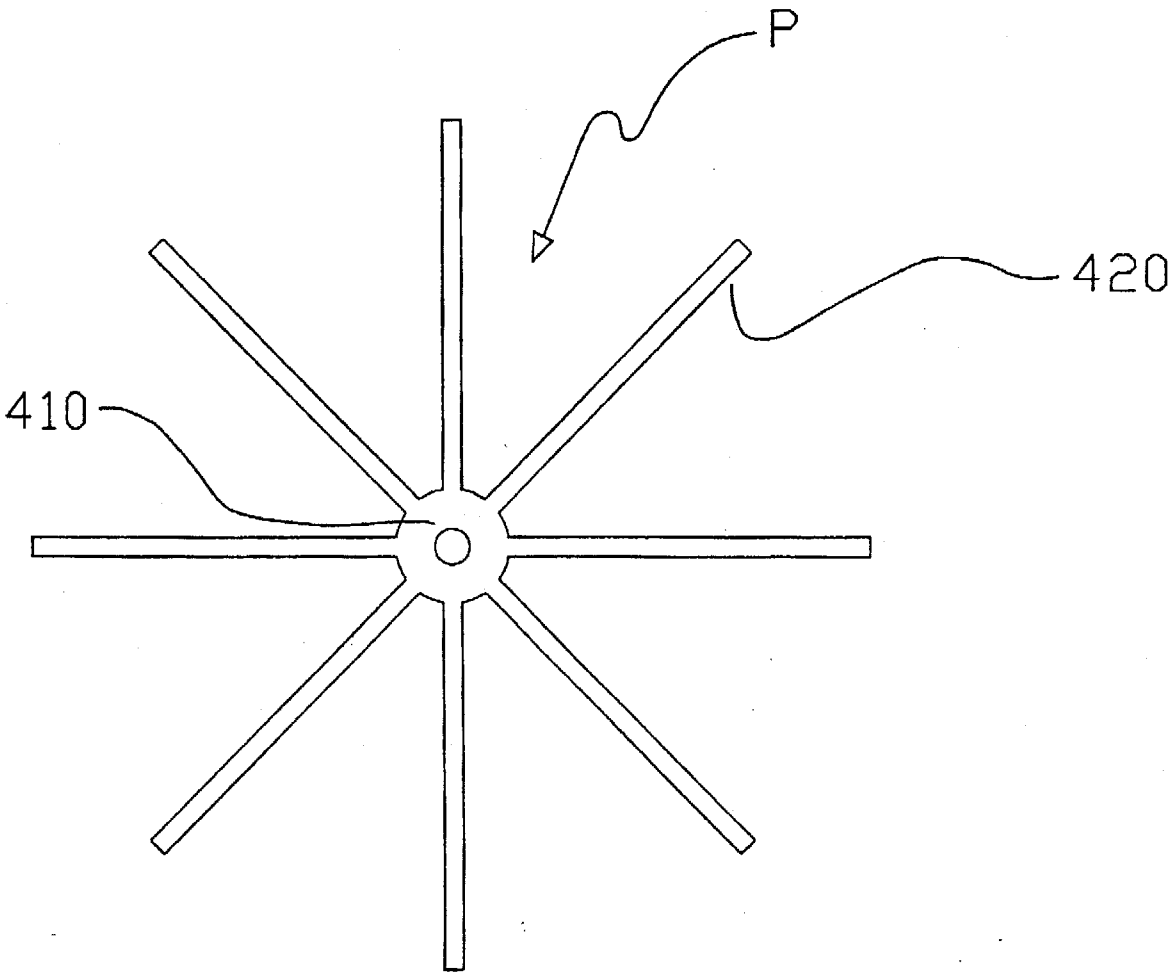
FIG. 13 is a top view of an arrangement of heater blades prior to folding.

Alternatively, the cylindrical configuration of heaters can be formed by stamping a pattern P as shown in FIG. 13 from an appropriate sheet of conducting material. Pattern P comprises a central hub 410 having a plurality of spaced arms 420 extending radially outward therefrom to form a spoke-like arrangement. The arms 420 are coated with an insulative layer and a resistive heater as discussed above. In one embodiment, the hub 410 serves as a common, with each of the resistive heaters respectively electrically connected to an associated arm 420, preferably at the end of the heater 122 farthest from the hub 410. A respective positive contact is provided for each heater, preferably at the end of heater 122 closest to hub 410 so that all of the connections, i.e., the positive heater connections and the common hub 410, are closely located. Next, the arms 420 are folded such that they are perpendicular to the plane of the hub to define a cylindrical receptacle. Depending on the direction of the fold, either the heaters 122 or the arm 420 will directly face the inserted cigarette.

Figure 12:
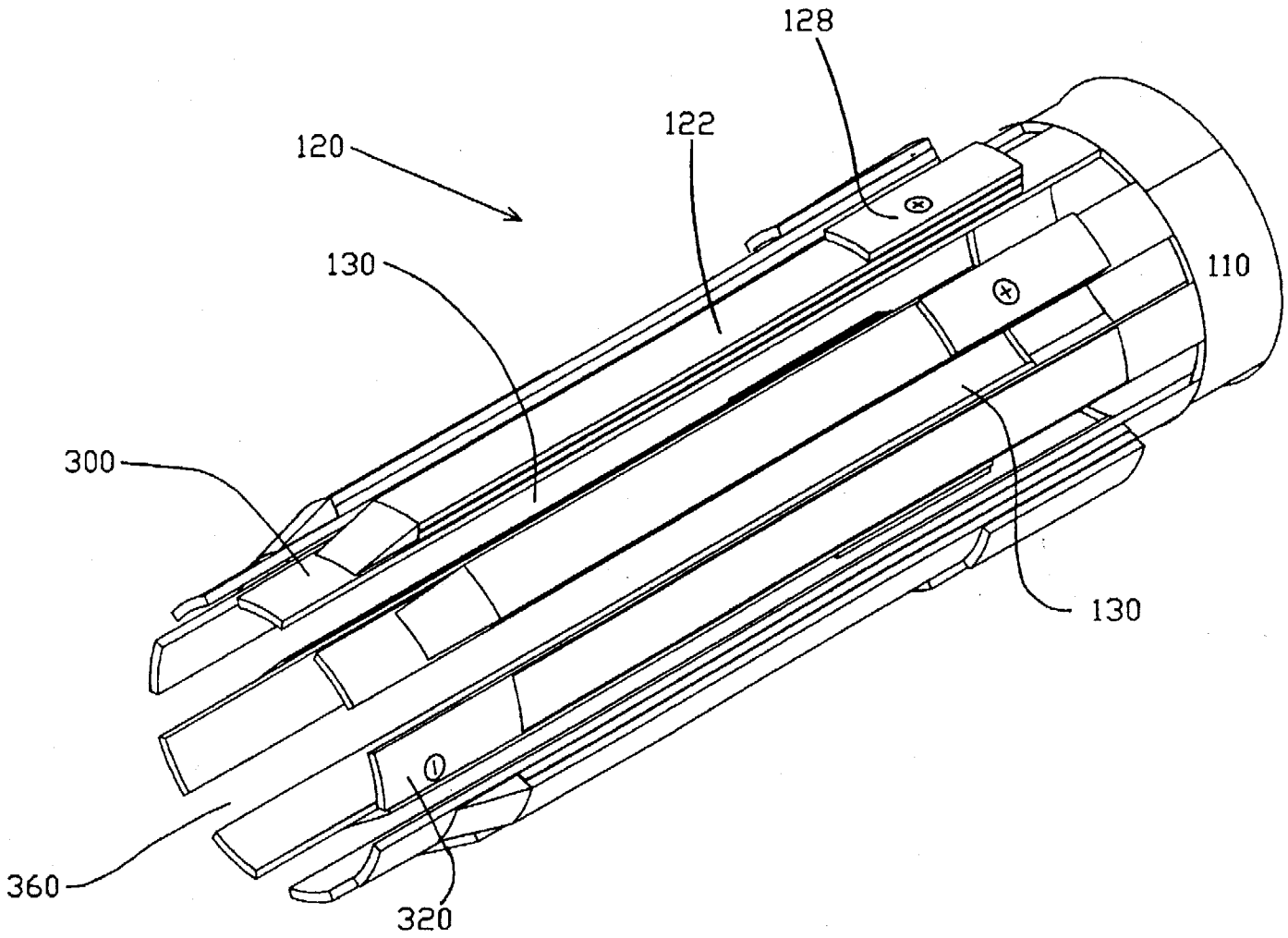
FIG. 12 is a perspective of view of a tubular heater having a common blade.

In any of the foregoing embodiments, a common blade 320 as shown in FIGS. 11 and 12 can be employed to electrically connect the common hub 110 to the power supply via pin 99B. Common blade 320 extends from hub 110 in the same direction as the other blades and is not coated with either a ceramic or resistive heater during fabrication, i.e., common blade 120 is masked to comprise the substrate 300. Alternatively, the common blade is coated with a ceramic 310 to electrically insulate the common blade from surrounding components. Accordingly, the negative common contact for all of the heaters 122 is formed at the end of common blade 320 opposite common hub 110. Similarly, the respective positive connections for each heater 122 are formed at the end of heater blades 120 opposite hub 110, such that electrical connections are at the end of the heater arrangement opposite common hub 110. Thus, if desired the common hub 110 can serve to define the insertion end 360 for the cigarette and the blades 120, 320 can be supported at an opposite end by, e.g., spacer 49.

In any of the embodiments, the negative connection for each heater can be made individually by, e.g., an appropriate negative contact deposited on an end of the heater opposite the respective positive contacts 128. Accordingly, in such an embodiment the blades and hub would not need to be electrically conducting. Also, in any of the embodiments a single heater can comprise a blade or other structure having the laminate configuration as disclosed with an appropriate negative connection to heat tobacco in the form of a cigarette as disclosed, a more conventional cigarette, a tobacco web of the smoking article disclosed in copending, commonly assigned U.S. patent application Ser. No. 105,346, filed Aug. 10, 1993, which is hereby incorporated by reference, or any other format.

Figure 14:
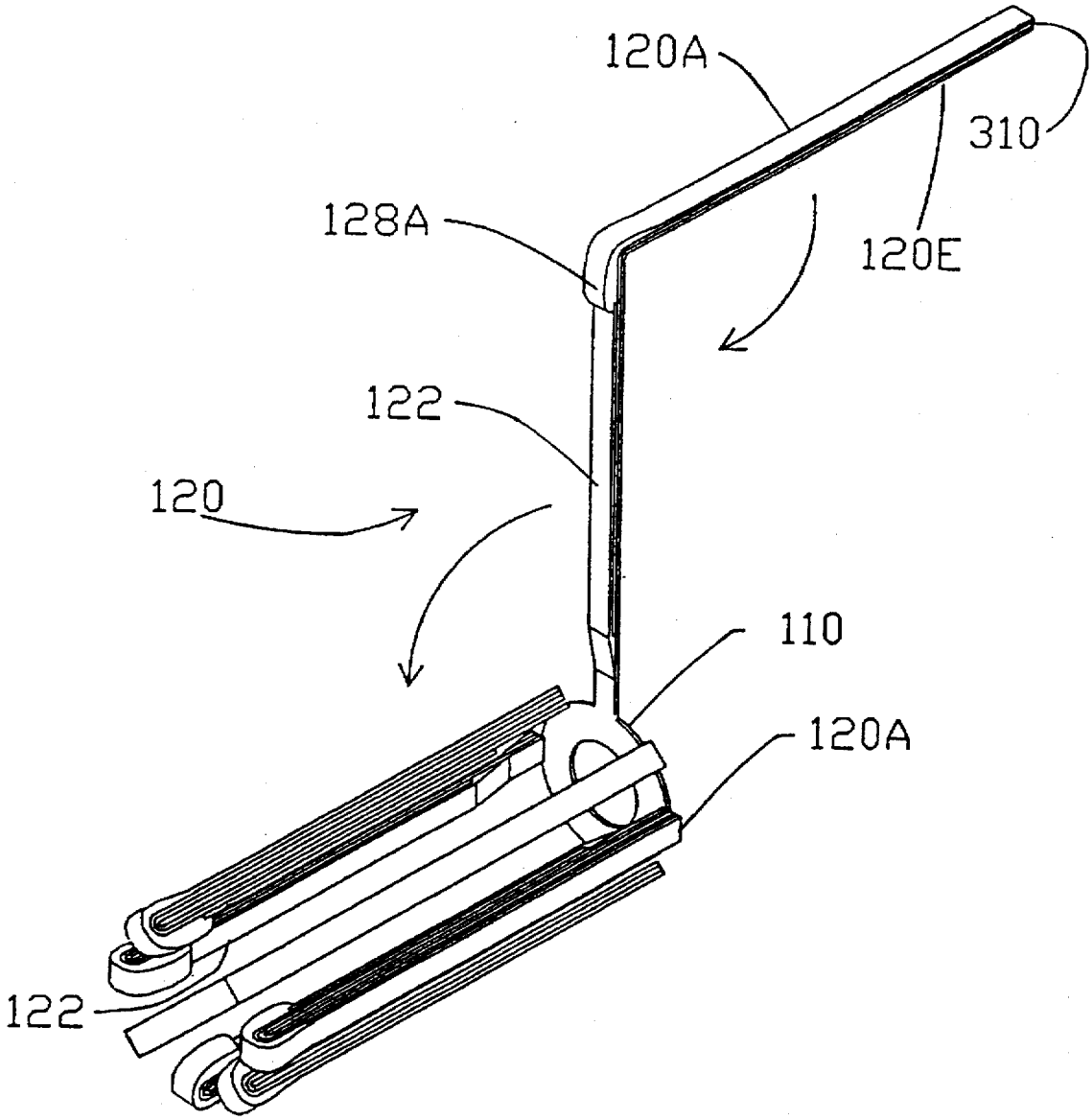
FIG. 14 is a perspective view of another arrangement of a tubular heater.

Referring to FIG. 14, another embodiment is shown wherein the blades 120 comprise an additional integral segment 120A. For example, the blades in FIG. 11 or the arms in FIG. 13 can be extended, e.g., approximately twice the length in the previous examples. A positive connection for each heater is provided by applying a ceramic electrically insulative layer to, e.g., extending layer 310 onto, substrate segment 120A as discussed and then applying a contact material 128A electrically contacting an end of resistive heater 122 on the ceramic coated segment 120A. Alternatively, a connecting wire or path, electrically insulated from the blade segment 120A, is employed in lieu of contact material 128A. The hub 110 and heater blades 120, and if desired barrier blades 220, are arranged as discussed in reference to FIGS. 11 and 13. The blade segment 120A is folded approximately 180° such that an end 120E opposite the connection with heater 120 is in proximity with common hub 110 and electrically contacts a respective pin 99A, to function as the positive contact, sure that all of the electrical connections are located toward hub 110. The fold area between section 120A and the section of blade 120 bearing heater element 122 can have narrower width than the rest of the blade. This folded blade can serve to flexibly form around an inserted cigarette, expanding slightly during insertion to receive the cigarette and than contracting snugly about the cigarette.

The various embodiments of the present invention are all designed to allow delivery of an effective amount of flavored tobacco response to the smoker under standard conditions of use. Particularly, it is presently understood to be desirable to deliver between 5 and 13 mg, preferably between 7 and 10 mg, of aerosol to a smoker for 8 puffs, each puff being a 35 ml puff having a two-second duration. It has been found that, in order to achieve such delivery, the heater elements 122 should be able to convey a temperature of between about 200° C. and about 900° C. when in a thermal transfer relationship with the cigarette 23. Further, the heater blades 120 should preferably consume between about 5 and about 40 Joules of energy, more preferably between about 10 Joules and about 25 Joules, and even more preferably about 20 Joules. Lower energy requirements are enjoyed by heater blades 120 that are bowed inwardly toward the cigarette 23 to improve the thermal transfer relationship.

Heater elements 122 having desired characteristics preferably have an active surface area of between about 3 $mm^2$ and about 25 $mm^2$ and preferably have a resistance of between about 0.5 Ω and about 3.0Ω. More preferably, the heater elements 122 should have a resistance of between about 0.8Ω and about 2.1 Ω. Of course, the heater resistance is also dictated by the particular power source 37 that is used to provide the necessary electrical energy to heat the heater elements 122. For example, the above heater element resistances correspond to embodiments where power is supplied by four nickel cadmium battery cells connected in series with a total non-loaded power source voltage of approximately 4.8 to 5.8 volts. In the alternative, if six or eight such series-connected batteries are used, the heater elements 122 should, preferably have a resistance of between about 3Ω and about 5Ω or between about 5 Ω and about 7Ω, respectively.

The materials of which the heater elements 122 are made are preferably chosen to ensure reliable repeated uses of at least 1800 on/off cycles without failure. The heater fixture 39 is preferably disposable separately from the lighter 25 including the power source 37 and the circuitry, which is preferably disposed of after 3600 cycles, or more. The heater element materials and other metallic components are also chosen based on their oxidation resistance and general lack of reactivities to ensure that they do not oxidize or otherwise react with the cigarette 23 at any temperature likely to be encountered. If desired, the heater elements 122 and other metallic components are encapsulated in an inert heat-conducting material such as a suitable ceramic material to further avoid oxidation and reaction.

Based on these criteria, materials for the electric heating means include doped semiconductors (e.g., silicon), carbon, graphite, stainless steel, tantalum, metal ceramic matrices, and metal alloys, such as, for example, iron containing alloys suitable metal-ceramic matrices include silicon carbide aluminum and silicon carbide titanium. Oxidation resistant intermetallic compounds, such as aluminides of nickel and aluminides of iron, are also suitable.

More preferably, however, the electric heater elements 122 and other metallic components are made from a heat-resistant alloy that exhibits a combination of high mechanical strength and resistance to surface degradation at high temperatures. The heater blade 120 can be formed in the serpentine shape disclosed in the parent application Ser. No. 08/118,665. Preferably, the heater elements 122 are made from a material that exhibits high strength and surface stability at temperatures up to about 80 percent of their melting points. Such alloys include those commonly referred to as super-alloys and are generally based on nickel, iron, or cobalt. For example, alloys of primarily iron or nickel with aluminum and yttrium are suitable. Preferably, the alloy of the heater elements 122 includes aluminum to further improve the performance of the heater element, e.g., by providing oxidation resistance. Preferably, both the heater elements 122 and the metal substrate 300 of the hubs and blades are any $Ni_3Al$ or $Fe_3Al$ alloy. The alloy disclosed in commonly assigned, copending U.S. patent application Ser. No. 08/365,952, filed Dec. 29, 1994 (Attorney Docket No. PM 1767) can also be employed.

Many modifications, substitutions and improvements may be apparent to the skilled artisan without departing from the spirit and scope of the present invention as described and defined herein and in the following claims.

We claim:

1. A heater for use in a smoking article having a source of electrical energy for heating a cylindrical cigarette, the heater comprising:

a cylindrical tube, said tube comprised of an electrically conducting material, said tube provided with a plurality of gaps therethrough to define (a) a plurality of electrically conducting blades defining a receptacle to receive an inserted cylindrical cigarette and (b) an electrically conducting, common end hub supported within the smoking article, the blades extending from the end hub;

an electrical insulator deposited on at least one of the plurality of electrically conducting blades;

an electrically resistive heater element deposited on said insulator, a first end of said heater element electrically connected to the at least one of the plurality of electrically conducting blades, a second end of said heater element and a portion of said heater element between the first and second ends electrically insulated from said at least one electrically conducting blade by said insulator;

wherein said end hub is in electrical contact with the source of electrical energy and the second end of said heater element is in electrical contact with the source of electrical energy, wherein a resistive heating circuit is formed to heat said electrically resistive heater element, which in turn heats the inserted cigarette.

2. The heater according to claim 1, wherein said electrical insulator is deposited on an outer surface of said tube opposite a surface of said tube facing the inserted cigarette.

3. The heater according to claim 1, wherein the at least, one blade, the deposited insulator, and the associated heater element have respective coefficients of thermal expansion to compensate for thermal expansion when the heater element is heated.

4. The heater according to claim 1, wherein the gaps extend longitudinally with respect to said tube to define a plurality of longitudinally extending blades.

5. The heater according to claim 1, wherein the gaps are spiralled.

6. The heater according to claim 1, wherein the gaps are from 5 to 15 mil.

7. The heater according to claim 1, wherein the gaps from 3 to 4 mil.

8. The heater according to claim 1, wherein said tube comprises an inlet for insertion of the cigarette and a narrowed section to provide intimate contact with the inserted cigarette.

9. The heater according to claim 8, wherein said inlet has a diameter slightly greater than the inserted cigarette.

10. The heater according to claim 8, wherein said tube further comprises a throat section between the inlet and the narrowed section, the throat section having a gradually decreasing diameter from the inlet end to the narrowed section.

11. The heater according to claim 8, wherein the blades are inwardly bowed to define the narrowed section.

12. The heater according to claim 8, wherein the inlet is located at an end of the tube opposite said common end hub and is defined by free ends of said blades.

13. The heater according to claim 8, further comprising another end hub located at an opposite end of said tube from the common end hub, the other end hub defining the inlet for insertion of the cigarette.

14. The heater according to claim 1, further comprising another end hub located at an opposite end of said tube from the common end hub.

15. The heater according to claim 14, wherein the gaps extend between the blades and the other end hub.

16. The heater according to claim 1, further comprising a positive electrical contact electrically connected to the second end of said heater element.

17. The heater according to claim 1, further comprising at least two electrical insulators respectively deposited on at least two of the plurality of blades and an associated heater element deposited on each of said insulators such that a first end of each associated heater element is electrically connected to the associated blade, wherein said common end hub serves as an electrical common for the associated heater elements and a second end of each associated heater element is respectively electrically connected to the source of electrical energy.

18. The heater according to claim 17, wherein insulators and associated heater elements are deposited on every other blade.

19. The heater according to claim 17, wherein insulators are deposited on each of the plurality of the blades, and an associated heater element is deposited on every other blade.

20. The heater according to claim 17, wherein the plurality of blades having an associated heater element is related to a predetermined number of desired puffs of the inserted cigarette.

21. The heater according to claim 17, wherein the number of blades having an associated heater elements is equal to the predetermined number of puffs.

22. The heater according to claim 17, wherein the number of blades having an associated heater element is equal to twice a predetermined number of desired puffs of the inserted cigarette.

23. The heater according to claim 17, wherein two blades having an associated heater element are resistively heated simultaneously.

24. The heater according to claim 17, wherein said electrical insulator is deposited on an outer surface of said tube opposite a surface of said tube facing the inserted cigarette.

25. The heater according to claim 17, wherein the at least two blades, the deposited insulators, and the associated heater elements have respective coefficients of thermal expansion to compensate for thermal expansion when the heater element is heated.

26. The heater according to claim 17, wherein the gaps extend longitudinally with respect to said tube to define a plurality of longitudinally extending blades.

27. The heater according to claim 17, wherein the gaps are spiralled with respect to a longitudinal axis of the tube to define a plurality of spiralled blades.

28. The heater according to claim 17, wherein the gaps are from 5–15 mil.

29. The heater according to claim 17, wherein the gaps are from 3–4 mil.

30. The heater according to claim 17, wherein said tube comprises an inlet for insertion of the cigarette and a narrowed section to provide intimate contact with the inserted cigarette.

31. The heater according to claim 30, wherein said inlet has a diameter slightly greater than the inserted cigarette.

32. The heater according to claim 30, wherein said tube further comprises a throat section between the inlet and the narrowed section, the throat section having a gradually decreasing diameter from the inlet end to the narrowed section.

33. The heater according to claim 30, wherein the blades are inwardly bowed to define the narrowed section.

34. The heater according to claim 30, wherein the inlet is located at an end of the tube opposite said end hub and is defined by free ends of said blades.

35. The heater according to claim 30, further comprising another end hub located at an opposite end of said tube from the end hub, the other end hub defining the inlet for insertion of the cigarette.

36. The heater according to claim 17, further comprising another end hub located at an opposite end of said tube from the end hub.

37. The heater according to claim 36, wherein the gaps extend between the blades and the other end hub.

38. The heater according to claim 1, wherein perforations are located through at least one of the blades.

39. The heater according to claim 1, wherein said electrical insulator is deposited on an inner surface of said tube such that said heater element faces the inserted cigarette.

40. The heater according to claim 17, wherein said electrical insulator is deposited on an inner surface of said tube such that said heater element faces the inserted cigarette.

41. The heater according to claim 1, wherein the elecrically conducting material of said cylindrical tube is selected from the group consisting of iron aluminides and nickel aluminides and said heater element comprises an electrically resistive material selected from the group consisting of iron aluminides and nickel aluminides.

42. The heater according to claim 1, wherein said electrically conducting tube comprising electrically reside, wherein said electrically resistive heater element comprises an iron aluminide, and wherein said electrical insulator is selected from the group consisting of alumina, zirconia, mulite, and mixtures of alumina and zirconia.

43. The heater according to claim 42, wherein said insulator comprises zirconia partially stabilized with yttria.

44. The heater according to claim 1, wherein said electrically conducting tube comprising an iron aluminide.

45. The heater according to claim 1, wherein said electrically resistive heater element comprises iron aluminide.

46. The heater according to claim 17, wherein said electrically conducting tube comprises an iron aluminide, wherein said electrically resistive heater element comprises an iron aluminide, and wherein said electrical insulator is selected form the group consisting of alumina, zirconia, mulite, and mixtures of alumina and zirconia.

47. The heater according to claim 1, wherein said electrically conducting tube comprises a nickel aluminide.

48. The heater according to claim 47, wherein said electrically resistive heater element comprises a nickel aluminide.

49. The heater according to claim 48, wherein said electrical insulator is selected from the group consisting of alumina, zirconia, mulite, and mixtures of alumina and zirconia.

50. The heater according to claim 49, wherein said electrical insulator comprises zirconia partially stabilized with yttria.

51. The heater according to claim 1, wherein said electrically resistive heater element comprises a nickel aluminide.

52. The heater according to claim 17, wherein said electrically resistive heater elements comprises an iron aluminide.

53. The heater according to claim 1, wherein at least one of said electrically conducting tube and said resistive heater element comprises approximately 77.92% Ni, approximately 21.73% Al, approximately 0.34% Zr and approximately 0.01% B.

54. The-heater according to claim 1, wherein said electrically conducting tube comprises a nickel aluminide having a modifier selected for the group consisting of Zr and B.

55. The heater according to claim 1, wherein said heater element comprises a nickel aluminide having a modifer selected from the group consisting of Zr and B.

56. The heater according to claim 17, wherein said cylindrical tube further comprises a common blade of electrically conducting material extending from the common end hub, said common blade in electrical contact with the source of electrical energy.

57. The heater according to claim 17, wherein said common hub defines an inlet for insertion of the cigarette, wherein the first end of said heater element is proximal relative to said common hub and the second end of said heater element is distal relative to said common hub.

58. The heater according to claim 12, wherein the first end of said heater element is distal relative to said common hub and the second end of said heater element is proximal relative to said common hub.

59. A heater for use in a smoking article having a source of electrical energy for heating tobacco flavor medium, the heater comprising:

a substrate of electrically conducting material;

an electrical insulator deposited on at least a portion of said substrate; and an electrically resistive heater element deposited on said electrical insulator, a first end of said heater element electrically connected to said electrically conducting substrate, wherein a second end of said heater element and a portion of said heater element between the first and second ends of said heater element are electrically insulated from said electrically conducting substrate by said insulator, wherein said substrate and said second end of said heater element are electrically connected to the source of electrical energy, wherein a resistive heating circuit is formed to heat said heating element, which in turn heats the tobacco flavor medium.

60. The heater according to claim 59, wherein said electrically conducting substrate comprises a material selected from the group consisting of iron aluminides and nickel aluminides, and wherein said resistive heating element comprises a material selected from the group consisting of iron aluminides and nickel aluminides.

61. The heater according to claim 60, wherein said electrical insulator is selected from the group consisting of alumina, zirconia, mulite, and mixtures of alumina and zirconia.

62. The heater according to claim 59, wherein said electrically conducting substrate comprises an iron aluminide.

63. The heater according to claim 62, wherein said electrically resistive heater element comprises iron aluminide.

64. The heater according to claim 63, wherein said electrical insulator is selected from the group consisting of alumina, zirconia, mulite, and mixtures of alumina and zirconia.

65. The heater according to claim 59, wherein said electrically conducting substrate comprises a nickel aluminide.

66. The heater according to claim 65, wherein said electrically resistive heater elements comprise a nickel aluminide.

67. The heater according to claim 66, wherein said electrical insulator is selected from the group consisting of alumina, zirconia, mulite, and mixtures of alumina and zirconia.

68. The heater according to claim 59, wherein said substrate is positioned to be in thermal proximity with the tobacco flavor medium.

69. The heater according to claim 64, wherein said resistive heating element is positioned to be in thermal proximity with the tobacco flavor medium.

70. A heater for use in an electrical smoking article having a source of electrical energy for heating tobacco flavor medium, the heater comprising:

a substrate comprising electrically conducting nickel aluminide;

a ceramic electrical insulator deposited on at least a portion of said substrate; and an electrically resistive heater element deposited on said ceramic insulator, said heater element comprising a resistive material selected from the group consisting of nickel aluminides and nickel aluminum, said heater element having first and second ends connected to the source of electrical energy, at least a portion of said heating element between the first and second ends being electrically insulated from said substrate by said insulator, wherein a resistive heating circuit is formed to heat said heater element which in turn heats the tobacco flavor medium.

71. The heater according to claim 70, wherein said electrical insulator is selected from the group consisting of alumina, zirconia, mulite, and mixtures of alumina and zirconia.

72. The heater according to claim 71, wherein said electrical insulator comprises zirconia partially stabilized with yttria.

73. The heater according to claim 72, wherein the zirconia is partially stabilized with approximately 20% yttria.

74. The heater according to claim 72, wherein the zirconia is stabilized with approximately 8% yttria.

75. The heater according to claim 70, wherein at least one of said substrate and said heater element comprises approximately 77.92% Ni, approximately 21:73% Al, approximately 0.34%. Zr and 0.01% B.

76. The heater according to claim 70, wherein the nickel aluminide of said substrate comprises a modifier selected from the group consisting of Zr and B.

77. The heater according to claim 70, wherein the nickel aluminide of said heater element is comprising a modifier selected from the group consisting of Zr and B.

78. The heater according to claim 70, wherein a first end of said heating element is electrically connected to said electrically conducting substrate and said substrate is electrically connected to the source of electrical energy, wherein the second end of said heating element is electrically insulated from said substrate by said insulator.

79. The heater according to claim 70, wherein the first and second ends of said heater are electrically insulated from said substrate by said ceramic insulation.

* * * * *